US009657674B2

(12) United States Patent
Jammoussi et al.

(10) Patent No.: US 9,657,674 B2
(45) Date of Patent: May 23, 2017

(54) METHOD AND SYSTEM FOR DETERMINING AIR-FUEL RATIO IMBALANCE

(71) Applicant: Ford Global Technologies, LLC, Dearborn, MI (US)

(72) Inventors: Hassene Jammoussi, Canton, MI (US); Imad Hassan Makki, Dearborn Heights, MI (US); Michael I. Kluzner, Oak Park, MI (US); Robert Roy Jentz, Westland, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 159 days.

(21) Appl. No.: 14/641,073

(22) Filed: Mar. 6, 2015

(65) Prior Publication Data

US 2016/0258375 A1 Sep. 8, 2016

(51) Int. Cl.

| | |
|---|---|
| ***F02D 41/12*** | (2006.01) |
| ***F02D 41/00*** | (2006.01) |
| ***F02D 41/14*** | (2006.01) |
| ***F02D 41/02*** | (2006.01) |
| ***F02D 41/22*** | (2006.01) |

(52) U.S. Cl.

CPC ..... *F02D 41/1475* (2013.01); *F02D 41/008* (2013.01); *F02D 41/0085* (2013.01); *F02D 41/0087* (2013.01); *F02D 41/0225* (2013.01); *F02D 41/123* (2013.01); *F02D 41/126* (2013.01); *F02D 41/1454* (2013.01); *F02D 41/222* (2013.01)

(58) Field of Classification Search

CPC .. F02D 41/123; F02D 41/126; F02D 41/1475; F02D 41/008; F02D 41/0087; F02D 41/1454

USPC ..... 123/673, 674, 675, 703, 344; 701/104, 701/103, 105, 102

See application file for complete search history.

(56) References Cited

U.S. PATENT DOCUMENTS

| | | | | |
|---|---|---|---|---|
| 6,244,043 | B1 * | 6/2001 | Farmer | B01D 53/9454 60/274 |
| 7,181,905 | B2 | 2/2007 | Surnilla et al. | |
| 2008/0243362 | A1 * | 10/2008 | Mitsuda | F02D 13/06 701/103 |

(Continued)

FOREIGN PATENT DOCUMENTS

| | | |
|---|---|---|
| EP | 2392810 A1 | 7/2011 |
| EP | 2711527 A1 | 3/2014 |

OTHER PUBLICATIONS

Gopalakrishnan, R., "Method and System for a Dual Loop Coolant System," U.S. Appl. No. 14/547,950, filed Nov. 19, 2014, 32 pages.

(Continued)

*Primary Examiner* — Mahmoud Gimie

(74) *Attorney, Agent, or Firm* — Julia Voutyras; McCoy Russell LLP

(57) ABSTRACT

Methods and systems are presented for assessing the presence or absence of cylinder air-fuel ratio deviation that may result in air-fuel ratio imbalance between engine cylinders. In one example, the method may include assessing the presence or absence of air-fuel ratio errors based on deviation from an expected air-fuel ratio during a deceleration fuel shut-off event.

20 Claims, 10 Drawing Sheets

(56) References Cited

U.S. PATENT DOCUMENTS

| | | | | |
|---|---|---|---|---|
| 2014/0202426 | A1 | 7/2014 | Surnilla et al. | |
| 2014/0290622 | A1 * | 10/2014 | Ikeda | F02D 41/0085 123/344 |

OTHER PUBLICATIONS

Ulrey, J. et al., "Method and System for Maintaining a DFSO," U.S. Appl. No. 14/611,385, filed Feb. 2, 2015, 49 pages.
Jammoussi, H. et al., "Method and System for Determining Air-Fuel Ratio Imbalance," U.S. Appl. No. 14/641,124, filed Mar. 6, 2015, 66 pages.

* cited by examiner

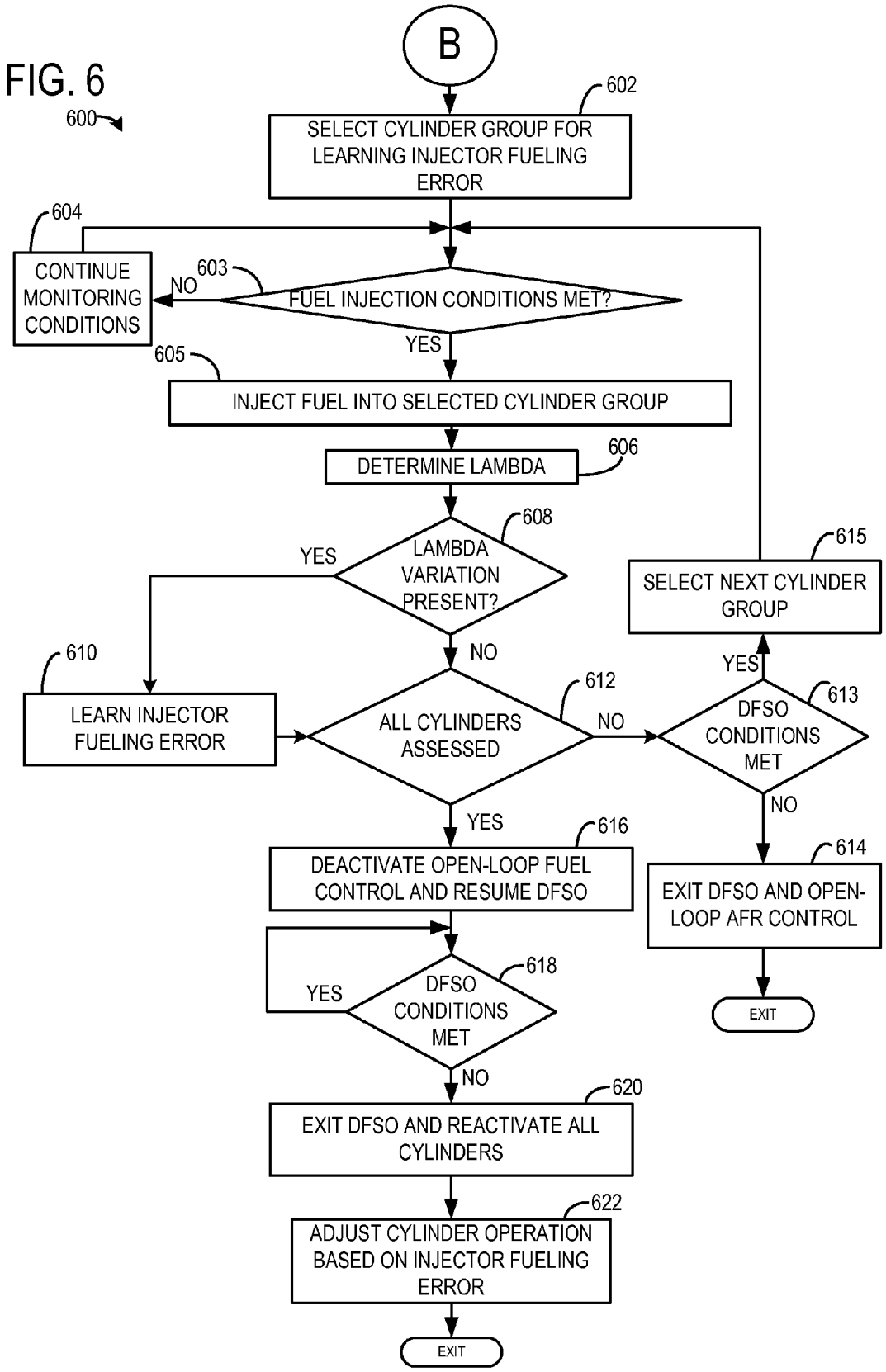
FIG. 6
600
B
602
SELECT CYLINDER GROUP FOR LEARNING INJECTOR FUELING ERROR
604
CONTINUE MONITORING CONDITIONS
NO
603
FUEL INJECTION CONDITIONS MET?
YES
605
INJECT FUEL INTO SELECTED CYLINDER GROUP
DETERMINE LAMBDA
606
608
YES
LAMBDA VARIATION PRESENT?
615
SELECT NEXT CYLINDER GROUP
NO
610
YES
612
613
LEARN INJECTOR FUELING ERROR
ALL CYLINDERS ASSESSED
NO
DFSO CONDITIONS MET
NO
YES
616
614
DEACTIVATE OPEN-LOOP FUEL CONTROL AND RESUME DFSO
EXIT DFSO AND OPEN-LOOP AFR CONTROL
618
YES
DFSO CONDITIONS MET
EXIT
NO
620
EXIT DFSO AND REACTIVATE ALL CYLINDERS
622
ADJUST CYLINDER OPERATION BASED ON INJECTOR FUELING ERROR
EXIT

METHOD AND SYSTEM FOR DETERMINING AIR-FUEL RATIO IMBALANCE

FIELD

The present description relates generally to methods and systems for controlling a vehicle engine to monitor an air-fuel ratio imbalance during decelerated fuel shut-off (DFSO).

BACKGROUND/SUMMARY

Engine air-fuel ratio may be maintained at a desired level (e.g., stoichiometric) in order to provide desired catalyst performance and reduced emissions. Typical feedback air-fuel ratio control includes monitoring of exhaust gas oxygen concentration by an exhaust sensor(s) and adjusting fuel and/or charge air parameters to meet a target air-fuel ratio. However, such feedback control may overlook cylinder-to-cylinder variation in air-fuel ratio (e.g., cylinder air-fuel ratio imbalance), which may degrade engine performance and emissions. While various approaches have been set forth for individual cylinder air-fuel control, with the aim at reducing cylinder to cylinder air-fuel ratio variation, such variation may still persist as recognized by the inventors herein. For example, issues with cylinder air-fuel ratio imbalance may include increased $NO_x$, CO, hydrocarbon emissions, knocking, poor combustion, and decreased fuel economy.

One example approach for air-fuel imbalance monitoring is shown by Nishikiori et al. in European Patent No. 2392810. Therein, fuel is cut-off to all cylinders of an engine and an air-fuel ratio of a cylinder that combusts a mixture after fuel cut-off is monitored. An air-fuel ratio imbalance, if any, is learned and applied to the cylinder upon activation of the engine cylinders.

However, the inventors herein have recognized potential issues with such systems. As one example, Nishikiori is able to only measure an exhaust gas of the final engine cylinder fired. In this way, Nishikiori may only measure the air-fuel ratio of a single cylinder during fuel cut-off before having to initiate all the cylinders of the engine again in order to measure another cylinder air-fuel ratio. This may cause reduced drivability of the vehicle along with decreased fuel economy. As a second example, Nishikiori relies on the air-fuel sensor to accurately measure an air-fuel ratio relative to stoichiometry (e.g., the air-fuel ratio of the final combusted cylinder is compared to a measured stoichiometric air-fuel ratio). However, many issues exist with this method. For example, a geometry of the exhaust manifold and a location of an air-fuel ratio sensor, particularly for V engines, may reduce the accuracy of air-fuel ratio measurements at stoichiometry due to sensor blindness.

In one example, the issues described above may be addressed by a method for sequentially firing a cylinder group, each having a selected fuel pulse width delivered, and identifying an air-fuel ratio imbalance among each cylinder based on a deviation from a maximum lean air-fuel ratio measured during a DFSO. In this way, an air-fuel ratio imbalance may be monitored with less concern for sensor blindness.

In the view above, the inventors have recognized that a more accurate method for detecting an air-fuel imbalance may exist during DFSO (e.g., a period of low driver demand torque where the engine continues to rotate and where spark and fuel cease to be supplied to one or more engine cylinders). For example, upon measuring a maximum air-fuel ratio during a DFSO, only a selected cylinder may be fired at a time (once or multiple times during the DFSO) in order to determine an air-fuel ratio imbalance for an individual cylinder of an engine compared to an expected deviation. Each cylinder of the engine may be operated in this way during the DFSO so that all cylinder imbalances can be monitored. Further, since the combustion during the DFSO does not need to make torque to drive the vehicle, a relatively small amount of fuel may be combusted at a relatively lean overall air-fuel ratio, for example only sufficient to provide complete combustion. In this way, measurements can be provided for one cylinder at a time with minimal impact on drivability during the DFSO.

As another example, a method may be configured to monitor an air-fuel imbalance during DFSO. The air-fuel imbalance detection may initiate upon detecting a maximum lean air-fuel ratio during DFSO. A cylinder or cylinder group may be selected based one or more of a firing time and cylinder position and the cylinder or cylinder group may be fired while other cylinders remain deactivated based on the DFSO event. An air-fuel ratio of the cylinder or cylinder group may be measured and compared to an expected air-fuel ratio. If a difference between the measured air-fuel ratio and the expected air-fuel ratio is greater than a threshold, then the cylinder or cylinder group may have an air-fuel ratio imbalance. The imbalance may be learned and applied to future cylinder operations subsequent termination of the DFSO. In this way, determining an air-fuel ratio of an individual cylinder may be improved.

The above discussion includes recognitions made by the inventors and not admitted to be generally known. It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIG. 6 represents a method for firing selected cylinder groups during open-loop air-fuel ratio control.

DETAILED DESCRIPTION

Figure 1:
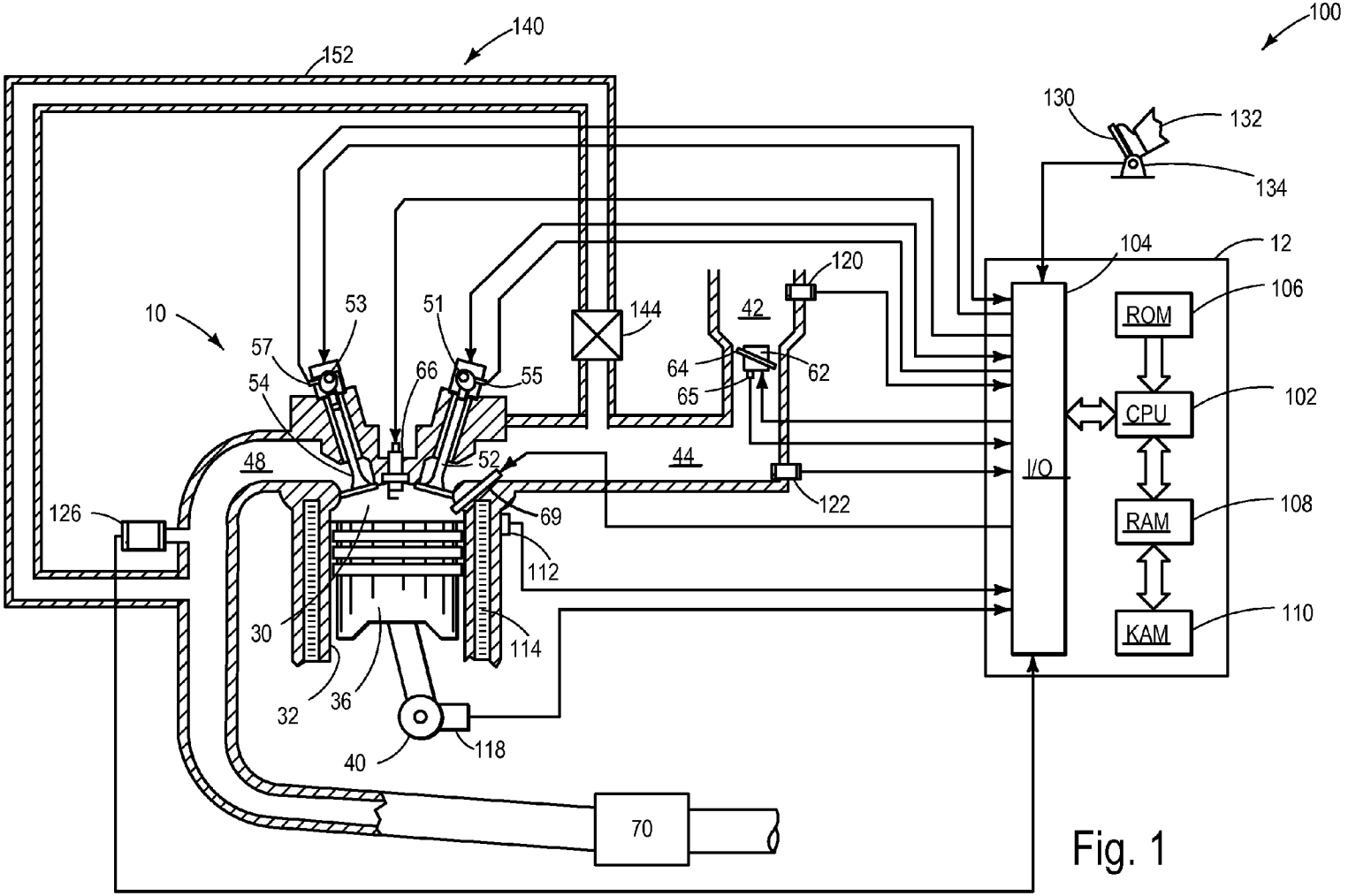
FIG. 1 represents an engine with a cylinder.
Figure 2:
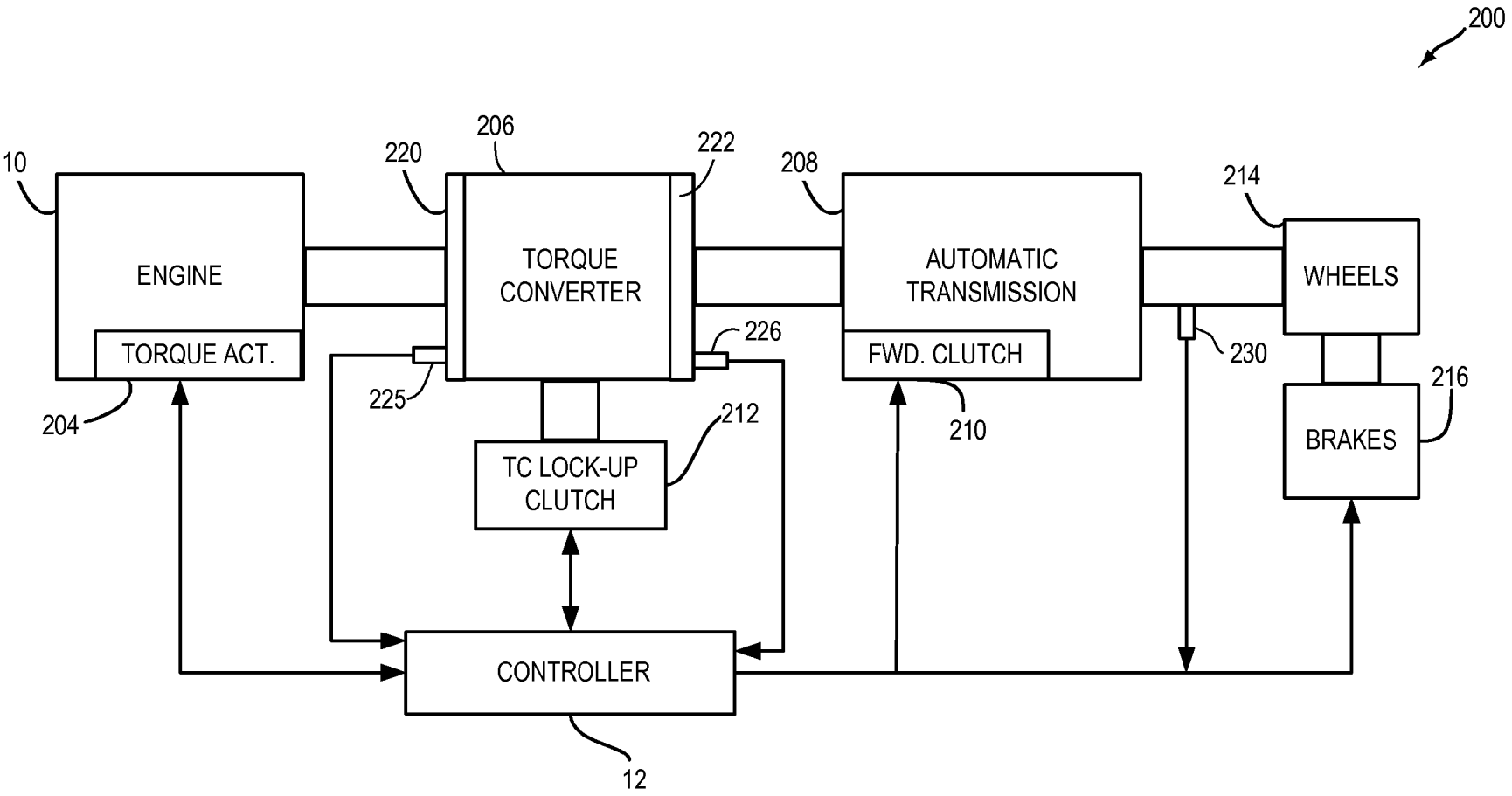
FIG. 2 represents an engine with a transmission and various components.
Figure 3:
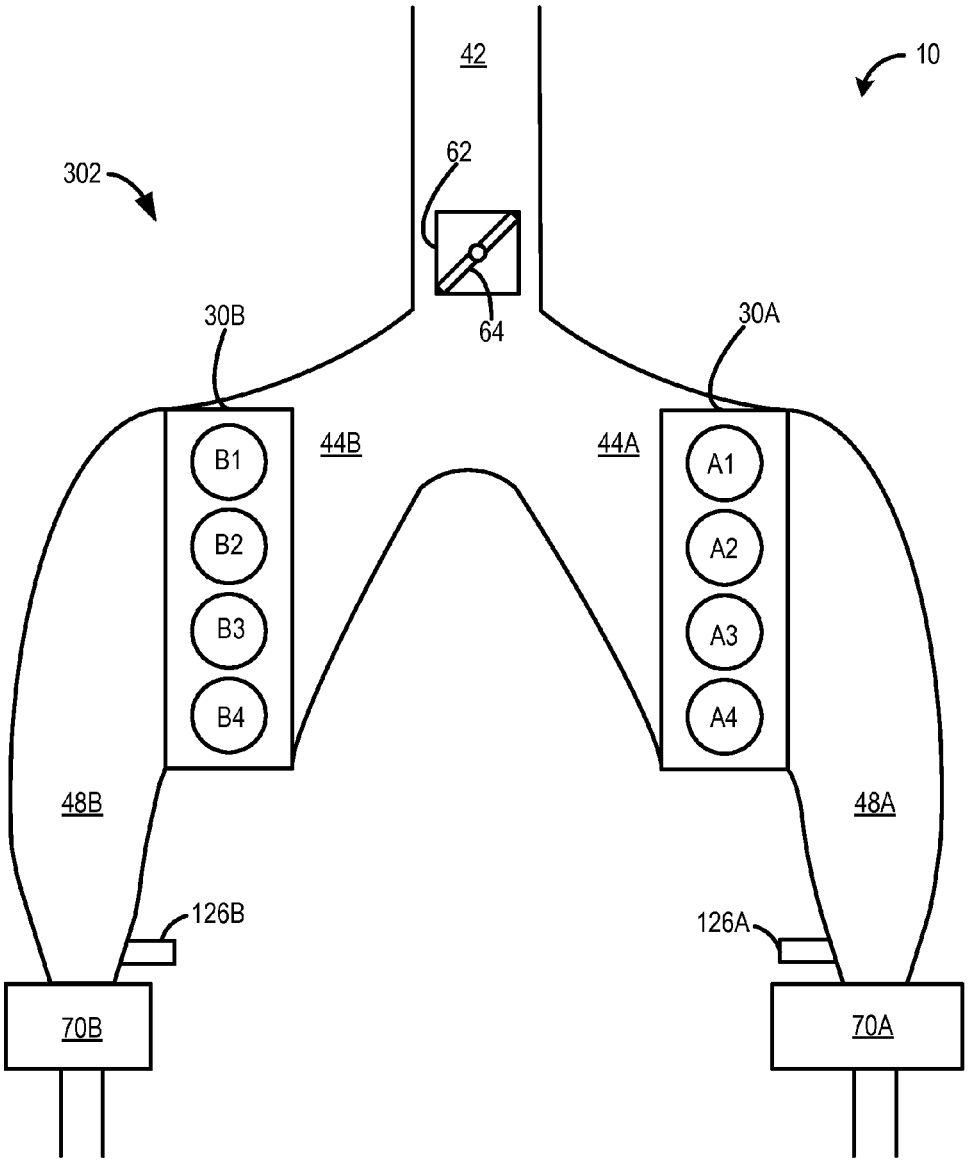
FIG. 3 represents a V-8 engine with two cylinder banks.
Figure 4:
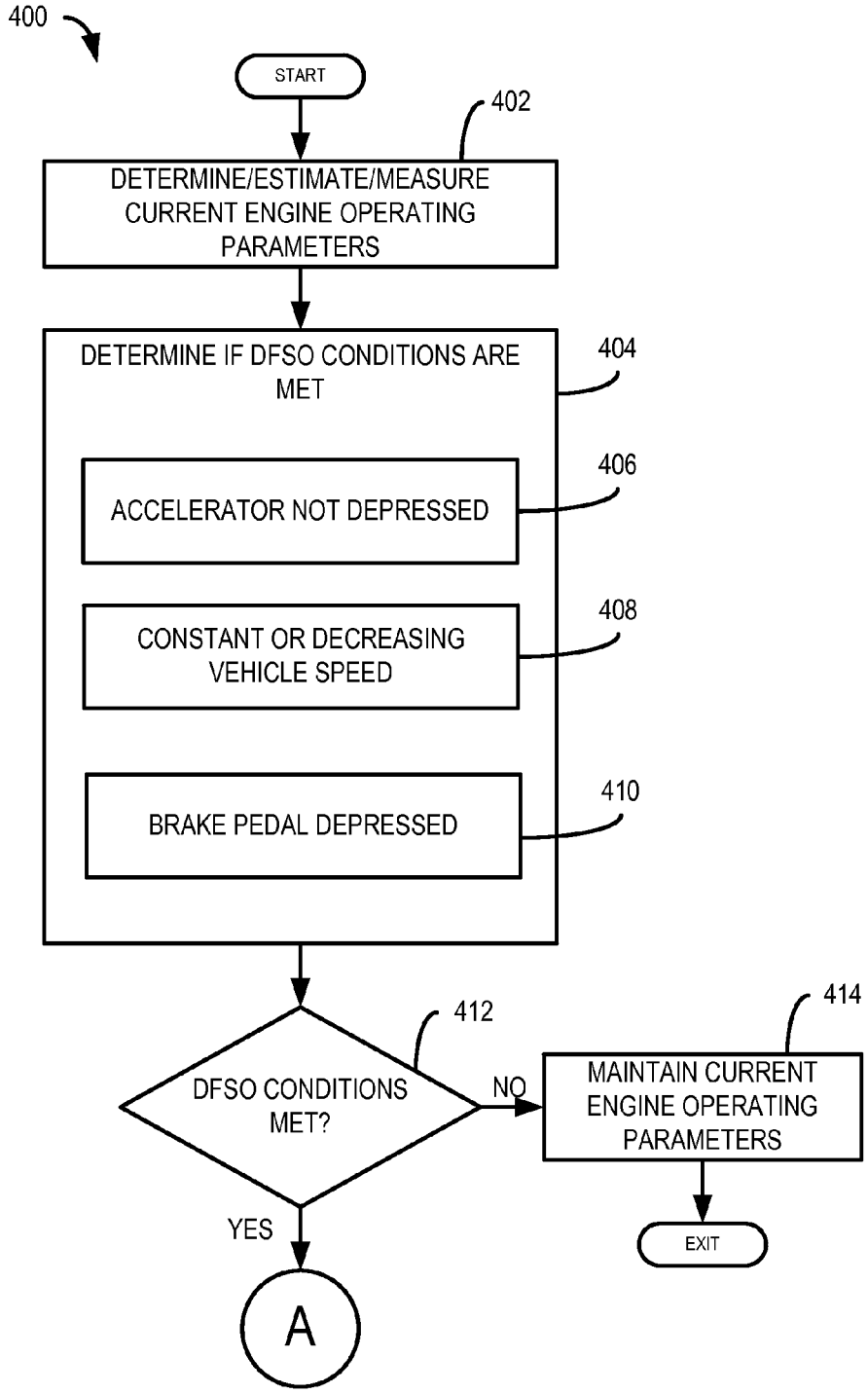
FIG. 4 represents a method for determining conditions for DFSO.
Figure 5:
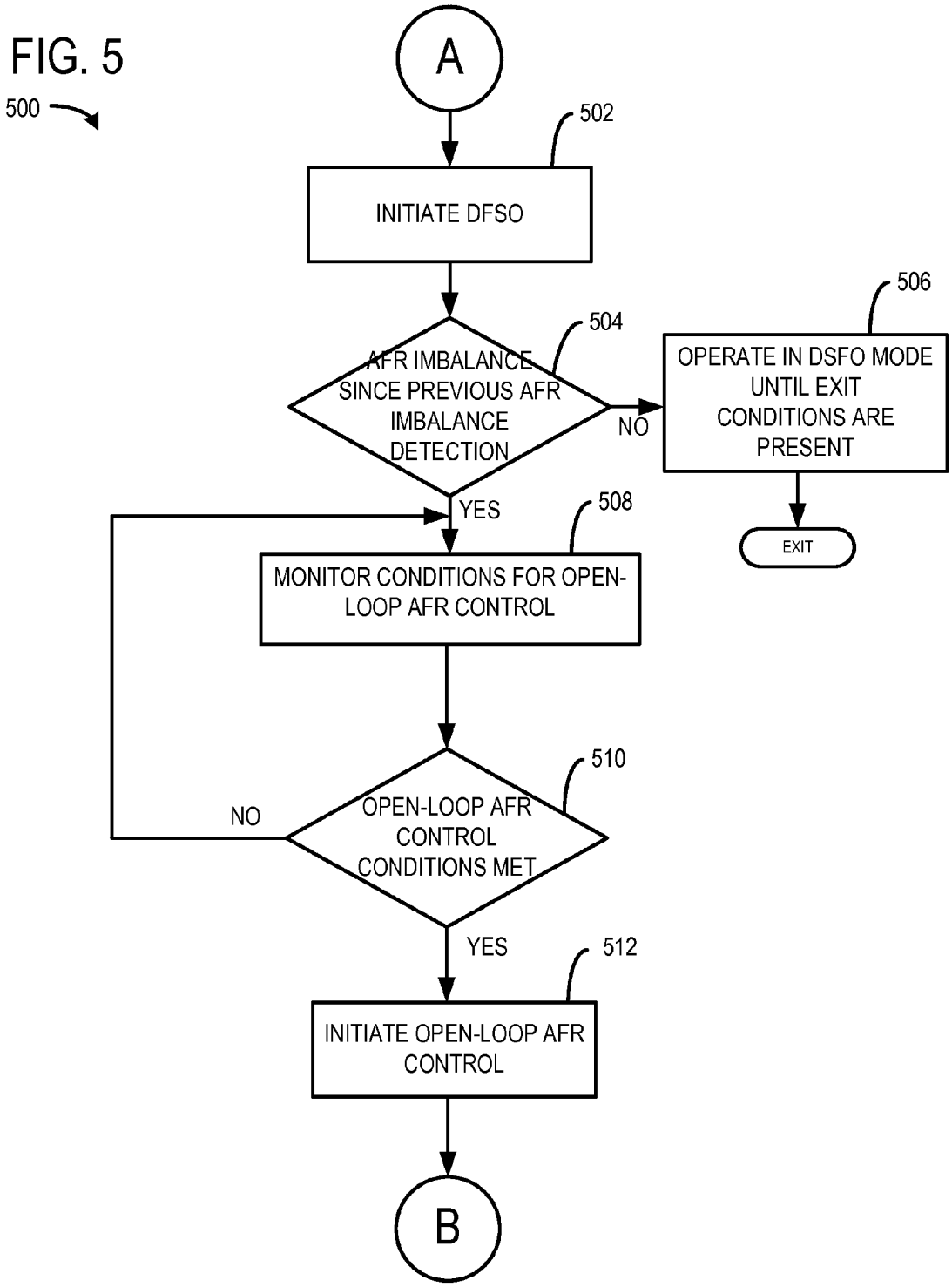
FIG. 5 represents a method for determining conditions and initiation of open-loop air-fuel ratio control.
Figure 7:
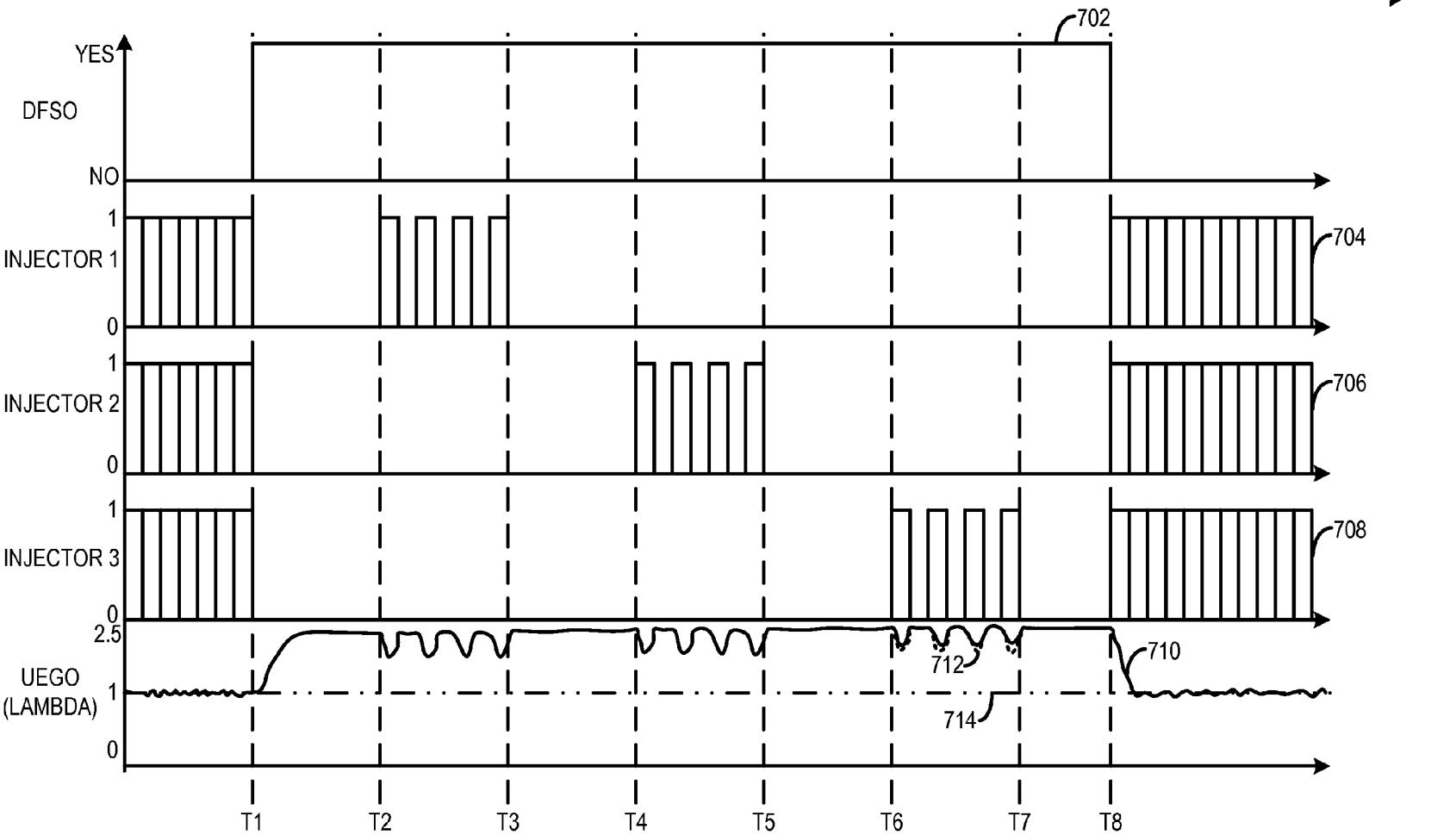
FIG. 7 represents a graphical data measured open-loop air-fuel ratio control.

The following description relates to systems and methods for detecting an air-fuel ratio imbalance (e.g., variations between air-fuel ratios of engine cylinders) during DFSO. FIG. 1 illustrates a single cylinder of an engine comprising an exhaust gas sensor upstream of an emission control device. FIG. 2 depicts an engine, transmission, and other vehicle components. FIG. 3 depicts a V-8 engine with two cylinder banks, two exhaust manifolds, and two exhaust gas sensors. FIG. 4 relates to a method for determining conditions for DFSO. FIG. 5 illustrates a method for initiating open-loop air-fuel ratio control during DFSO. FIG. 6 illustrates an exemplary method for carrying out the open-loop air-fuel ratio control. FIG. 7 graphically illustrates results of an open-loop air-fuel ratio control. Finally, a DFSO sequence where lambda variation analysis is delayed to reduce the possibility of lambda variation is shown.

Continuing to FIG. 1, a schematic diagram showing one cylinder of a multi-cylinder engine 10 in an engine system 100, which may be included in a propulsion system of an automobile, is shown. The engine 10 may be controlled at least partially by a control system including a controller 12 and by input from a vehicle operator 132 via an input device 130. In this example, the input device 130 includes an accelerator pedal and a pedal position sensor 134 for generating a proportional pedal position signal. A combustion chamber 30 of the engine 10 may include a cylinder formed by cylinder walls 32 with a piston 36 positioned therein. The piston 36 may be coupled to a crankshaft 40 so that reciprocating motion of the piston is translated into rotational motion of the crankshaft. The crankshaft 40 may be coupled to at least one drive wheel of a vehicle via an intermediate transmission system. Further, a starter motor may be coupled to the crankshaft 40 via a flywheel to enable a starting operation of the engine 10.

The combustion chamber 30 may receive intake air from an intake manifold 44 via an intake passage 42 and may exhaust combustion gases via an exhaust passage 48. The intake manifold 44 and the exhaust passage 48 can selectively communicate with the combustion chamber 30 via respective intake valve 52 and exhaust valve 54. In some examples, the combustion chamber 30 may include two or more intake valves and/or two or more exhaust valves.

In this example, the intake valve 52 and exhaust valve 54 may be controlled by cam actuation via respective cam actuation systems 51 and 53. The cam actuation systems 51 and 53 may each include one or more cams and may utilize one or more of cam profile switching (CPS), variable cam timing (VCT), variable valve timing (VVT), and/or variable valve lift (VVL) systems that may be operated by the controller 12 to vary valve operation. The position of the intake valve 52 and exhaust valve 54 may be determined by position sensors 55 and 57, respectively. In alternative examples, the intake valve 52 and/or exhaust valve 54 may be controlled by electric valve actuation. For example, the cylinder 30 may alternatively include an intake valve controlled via electric valve actuation and an exhaust valve controlled via cam actuation including CPS and/or VCT systems.

A fuel injector 69 is shown coupled directly to combustion chamber 30 for injecting fuel directly therein in proportion to the pulse width of a signal received from the controller 12. In this manner, the fuel injector 69 provides what is known as direct injection of fuel into the combustion chamber 30. The fuel injector may be mounted in the side of the combustion chamber or in the top of the combustion chamber, for example. Fuel may be delivered to the fuel injector 69 by a fuel system (not shown) including a fuel tank, a fuel pump, and a fuel rail. In some examples, the combustion chamber 30 may alternatively or additionally include a fuel injector arranged in the intake manifold 44 in a configuration that provides what is known as port injection of fuel into the intake port upstream of the combustion chamber 30.

Spark is provided to combustion chamber 30 via spark plug 66. The ignition system may further comprise an ignition coil (not shown) for increasing voltage supplied to spark plug 66. In other examples, such as a diesel, spark plug 66 may be omitted.

The intake passage 42 may include a throttle 62 having a throttle plate 64. In this particular example, the position of throttle plate 64 may be varied by the controller 12 via a signal provided to an electric motor or actuator included with the throttle 62, a configuration that is commonly referred to as electronic throttle control (ETC). In this manner, the throttle 62 may be operated to vary the intake air provided to the combustion chamber 30 among other engine cylinders. The position of the throttle plate 64 may be provided to the controller 12 by a throttle position signal. The intake passage 42 may include a mass air flow sensor 120 and a manifold air pressure sensor 122 for sensing an amount of air entering engine 10.

An exhaust gas sensor 126 is shown coupled to the exhaust passage 48 upstream of an emission control device 70 according to a direction of exhaust flow. The sensor 126 may be any suitable sensor for providing an indication of exhaust gas air-fuel ratio such as a linear oxygen sensor or UEGO (universal or wide-range exhaust gas oxygen), a two-state oxygen sensor or EGO, a HEGO (heated EGO), a $NO_x$, HC, or CO sensor. In one example, upstream exhaust gas sensor 126 is a UEGO configured to provide output, such as a voltage signal, that is proportional to the amount of oxygen present in the exhaust. Controller 12 converts oxygen sensor output into exhaust gas air-fuel ratio via an oxygen sensor transfer function.

The emission control device 70 is shown arranged along the exhaust passage 48 downstream of the exhaust gas sensor 126. The device 70 may be a three way catalyst (TWC), $NO_x$ trap, various other emission control devices, or combinations thereof. In some examples, during operation of the engine 10, the emission control device 70 may be periodically reset by operating at least one cylinder of the engine within a particular air-fuel ratio.

An exhaust gas recirculation (EGR) system 140 may route a desired portion of exhaust gas from the exhaust passage 48 to the intake manifold 44 via an EGR passage 152. The amount of EGR provided to the intake manifold 44 may be varied by the controller 12 via an EGR valve 144. Under some conditions, the EGR system 140 may be used to regulate the temperature of the air-fuel mixture within the combustion chamber, thus providing a method of controlling the timing of ignition during some combustion modes.

The controller 12 is shown in FIG. 2 as a microcomputer, including a microprocessor unit 102, input/output ports 104, an electronic storage medium for executable programs and calibration values shown as read only memory chip 106 (e.g., non-transitory memory) in this particular example, random access memory 108, keep alive memory 110, and a data bus. The controller 12 may receive various signals from sensors coupled to the engine 10, in addition to those signals previously discussed, including measurement of inducted mass air flow (MAF) from the mass air flow sensor 120; engine coolant temperature (ECT) from a temperature sensor 112 coupled to a cooling sleeve 114; an engine position signal from a Hall effect sensor 118 (or other type) sensing a position of crankshaft 40; throttle position from a throttle position sensor 65; and manifold absolute pressure (MAP)

signal from the sensor 122. An engine speed signal may be generated by the controller 12 from crankshaft position sensor 118. Manifold pressure signal also provides an indication of vacuum, or pressure, in the intake manifold 44. Note that various combinations of the above sensors may be used, such as a MAF sensor without a MAP sensor, or vice versa. During engine operation, engine torque may be inferred from the output of MAP sensor 122 and engine speed. Further, this sensor, along with the detected engine speed, may be a basis for estimating charge (including air) inducted into the cylinder. In one example, the crankshaft position sensor 118, which is also used as an engine speed sensor, may produce a predetermined number of equally spaced pulses every revolution of the crankshaft.

The storage medium read-only memory 106 can be programmed with computer readable data representing non-transitory instructions executable by the processor 102 for performing the methods described below as well as other variants that are anticipated but not specifically listed.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g., when combustion chamber 30 is at its largest volume) is typically referred to by those of skill in the art as bottom dead center (BDC).

During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g., when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion.

During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

As described above, FIG. 1 shows only one cylinder of a multi-cylinder engine, and each cylinder may similarly include its own set of intake/exhaust valves, fuel injector, spark plug, etc.

As will be appreciated by someone skilled in the art, the specific routines described below in the flowcharts may represent one or more of any number of processing strategies such as event driven, interrupt-driven, multi-tasking, multi-threading, and the like. As such, various acts or functions illustrated may be performed in the sequence illustrated, in parallel, or in some cases omitted. Like, the order of processing is not necessarily required to achieve the features and advantages, but is provided for ease of illustration and description. Although not explicitly illustrated, one or more of the illustrated acts or functions may be repeatedly performed depending on the particular strategy being used. Further, these Figures graphically represent code to be programmed into the computer readable storage medium in controller 12 to be carried out by the controller in combination with the engine hardware, as illustrated in FIG. 1.

FIG. 2 is a block diagram of a vehicle drive-train 200. Drive-train 200 may be powered by engine 10. In one example, engine 10 may be a gasoline engine. In alternate examples, other engine configurations may be employed, for example, a diesel engine. Engine 10 may be started with an engine starting system (not shown). Further, engine 10 may generate or adjust torque via torque actuator 204, such as a fuel injector, throttle, etc.

An engine output torque may be transmitted to torque converter 206 to drive an automatic transmission 208 by engaging one or more clutches, including forward clutch 210, where the torque converter may be referred to as a component of the transmission. Torque converter 206 includes an impeller 220 that transmits torque to turbine 222 via hydraulic fluid. One or more clutches may be engaged to change mechanical advantage between the engine vehicle wheels 214. Impeller speed may be determined via speed sensor 225, and turbine speed may be determined from speed sensor 226 or from vehicle speed sensor 230. The output of the torque converter may in turn be controlled by torque converter lock-up clutch 212. As such, when torque converter lock-up clutch 212 is fully disengaged, torque converter 206 transmits torque to automatic transmission 208 via fluid transfer between the torque converter turbine and torque converter impeller, thereby enabling torque multiplication. In contrast, when torque converter lock-up clutch 212 is fully engaged, the engine output torque is directly transferred via the torque converter clutch to an input shaft (not shown) of transmission 208. Alternatively, the torque converter lock-up clutch 212 may be partially engaged, thereby enabling the amount of torque relayed to the transmission to be adjusted. A controller 12 may be configured to adjust the amount of torque transmitted by the torque converter by adjusting the torque converter lock-up clutch in response to various engine operating conditions, or based on a driver-based engine operation request.

Torque output from the automatic transmission 208 may in turn be relayed to wheels 214 to propel the vehicle. Specifically, automatic transmission 208 may adjust an input driving torque at the input shaft (not shown) responsive to a vehicle traveling condition before transmitting an output driving torque to the wheels.

Further, wheels 214 may be locked by engaging wheel brakes 216. In one example, wheel brakes 216 may be engaged in response to the driver pressing his foot on a brake pedal (not shown). In the similar way, wheels 214 may be unlocked by disengaging wheel brakes 216 in response to the driver releasing his foot from the brake pedal.

A mechanical oil pump (not shown) may be in fluid communication with automatic transmission 208 to provide hydraulic pressure to engage various clutches, such as forward clutch 210 and/or torque converter lock-up clutch 212. The mechanical oil pump may be operated in accordance with torque converter 206, and may be driven by the rotation of the engine or transmission input shaft, for example. Thus, the hydraulic pressure generated in mechanical oil pump may increase as an engine speed increases, and may decrease as an engine speed decreases.

FIG. 3 shows an example version of engine 10 that includes multiple cylinders arranged in a V configuration. In this example, engine 10 is configured as a variable displacement engine (VDE). Engine 10 includes a plurality of combustion chambers or cylinders 30. The plurality of cylinders 30 of engine 10 are arranged as groups of cylinders on distinct engine banks. In the depicted example, engine 10 includes two engine cylinder banks 30A, 30B. Thus, the cylinders are arranged as a first group of cylinders (four cylinders in the depicted example) arranged on first engine bank 30A and label A1-A4, and a second group of cylinders (four cylinders in the depicted example) arranged on second engine bank 30B labeled B1-B4. It will be appreciated that while the example depicted in FIG. 1 shows a V-engine with cylinders arranged on different banks, this is not meant to be limiting, and in alternate examples, the engine may be an in-line engine with all engine cylinders on a common engine bank.

Engine 10 can receive intake air via an intake passage 42 communicating with branched intake manifold 44A, 44B. Specifically, first engine bank 30A receives intake air from intake passage 42 via a first intake manifold 44A while second engine bank 30B receives intake air from intake passage 142 via second intake manifold 44B. While engine banks 30A, 30B are shown with a common intake manifold, it will be appreciated that in alternate examples, the engine may include two separate intake manifolds. The amount of air supplied to the cylinders of the engine can be controlled by adjusting a position of throttle 62 on throttle plate 64. Additionally, an amount of air supplied to each group of cylinders on the specific banks can be adjusted by varying an intake valve timing of one or more intake valves coupled to the cylinders.

Combustion products generated at the cylinders of first engine bank 30A are directed to one or more exhaust catalysts in first exhaust manifold 48A where the combustion products are treated before being vented to the atmosphere. A first emission control device 70A is coupled to first exhaust manifold 48A. First emission control device 70A may include one or more exhaust catalysts, such as a close-coupled catalyst. In one example, the close-coupled catalyst at emission control device 70A may be a three-way catalyst. Exhaust gas generated at first engine bank 30A is treated at emission control device 70A Combustion products generated at the cylinders of second engine bank 30B are exhausted to the atmosphere via second exhaust manifold 48B. A second emission control device 70B is coupled to second exhaust manifold 48B. Second emission control device 70B may include one or more exhaust catalysts, such as a close-coupled catalyst. In one example, the close-coupled catalyst at emission control device 70A may be a three-way catalyst. Exhaust gas generated at second engine bank 30B is treated at emission control device 70B.

As described above, a geometry of an exhaust manifold may affect an exhaust gas sensor measurement of an air-fuel ratio of a cylinder during nominal engine operation. During nominal engine operation (e.g., all engine cylinder operating at stoichiometry), the geometry of the exhaust manifold may allow the air-fuel ratio of certain cylinders of an engine bank to be read more predominantly when compared to other cylinders of the same bank, thus reducing a sensitivity of the exhaust gas sensor to detect an air-fuel ratio imbalance of an individual sensor. For example, engine bank 30A comprises four cylinders A1, A2, A3, and A4. During nominal engine operation, exhaust gas from A1 may flow toward a side of the exhaust manifold nearest the exhaust gas sensor 126A and therefore, give a strong, accurate exhaust sensor reading. However, during nominal engine operation, exhaust gas from A4 may flow toward a side of the exhaust manifold farthest from the exhaust gas sensor 126A and therefore, give a weak, inaccurate exhaust sensor reading. In this way, it is difficult to attribute an air-fuel ratio (e.g., lambda) to cylinder A4 with great certainty during nominal engine operation. Thus, it may be preferred to deactivate all but one cylinder of an engine bank and to measure the air-fuel ratio of the activated cylinder.

While FIG. 3 shows each engine bank coupled to respective underbody emission control devices, in alternate examples, each engine bank may be coupled to respective emission control devices 70A, 70B but to a common underbody emission control device positioned downstream in a common exhaust passageway.

Various sensors may be coupled to engine 302. For example, a first exhaust gas sensor 126A may be coupled to the first exhaust manifold 48A of first engine bank 30A, upstream of first emission control device 70A while a second exhaust gas sensor 126B is coupled to the second exhaust manifold 48B of second engine bank 30B, upstream of second emission control device 70B. In further examples, additional exhaust gas sensors may be coupled downstream of the emission control devices. Still other sensors, such as temperature sensors, may be included, for example, coupled to the underbody emission control device(s). As elaborated in FIG. 2, the exhaust gas sensors 126A and 126B may include exhaust gas oxygen sensors, such as EGO, HEGO, or UEGO sensors.

One or more engine cylinders may be selectively deactivated during selected engine operating conditions. For example, during DFSO, one or more cylinders of an engine may be deactivated while the engine continues to rotate. The cylinder deactivation may include deactivating fuel and spark to the deactivated cylinders. In addition, air may continue to flow through the deactivated cylinders in which an exhaust gas sensor may measure a maximum lean air-fuel ratio upon entering the DFSO. In one example, an engine controller may selectively deactivate all the cylinders of an engine during a shift to DFSO and then reactivate all the cylinders during a shift back to non-DFSO mode.

FIG. 4 illustrates an example method 400 for d DFSO conditions in a motor vehicle. DFSO may be used to increase fuel economy by shutting-off fuel injection to one or more cylinders of an engine. In some examples, an open-loop air-fuel ratio control during DFSO may be used to determine an air-fuel ratio of an engine cylinder, as will be described in more detail below, DFSO conditions are described in further detail below.

Method 400 begins at 402, which includes determining, estimating, and/or measuring current engine operating parameters. The current engine operating parameters may include a vehicle speed, throttle position, and/or an air-fuel ratio. At 404, the method 400 includes determining if one or more DFSO activation conditions are met. DFSO conditions may include but are not limited to one or more of an accelerator not being depressed 406, a constant or decreasing vehicle speed 408, and a brake pedal being depressed 410. An accelerator position sensor may be used to determine the accelerator pedal position. The accelerator pedal position may occupy a base position when the accelerator pedal is not applied or depressed, and the accelerator pedal may move away from the base position as accelerator application is increased. Additionally or alternatively, accelerator pedal position may be determined via a throttle position sensor in examples where the accelerator pedal is coupled to the throttle or in examples where the throttle is operated in an accelerator pedal follower mode. A constant or decreasing vehicle speed may be preferred for a DFSO to occur due to a torque demand being either constant or not increasing. The vehicle speed may be determined by a vehicle speed sensor. The brake pedal being depressed may be determined via a brake pedal sensor. In some examples, other suitable conditions may exist for DFSO to occur.

At 412, the method 400 judges if one or more of the above listed DFSO conditions is met. If the condition(s) is met, then the method 400 may proceed to 502 of method 500, which will be described in further detail with respect to FIG. 5. If none of the conditions are met, then the method 400 may proceed to 414 maintain current engine operating parameters and not initiate DFSO. The method may exit after current engine operating conditions are maintained.

In some examples, a GPS/navigation system may be used to predict when DFSO conditions will be met. Information used by the GPS to predict DFSO conditions being met may include but is not limited to route direction, traffic information, and/or weather information. As an example, the GPS may be able to detect traffic downstream of a driver's current path and predict one or more of the DFSO condition(s) occurring. By predicting one or more DFSO condition(s) being met, the controller may be able to plan when to initiate DFSO.

Method 400 is an example method for a controller (e.g., controller 12) to determine if a vehicle may enter DFSO. Upon meeting one or more DFSO conditions, the controller (e.g., the controller in combination with one or more additional hardware devices, such as sensors, valves, etc.) may perform method 500 of FIG. 5.

FIG. 5 illustrates an exemplary method 500 for determining if open-loop air-fuel ratio control conditions are met. In one example, open-loop air-fuel ratio control may be initiated after a threshold number of vehicle miles are driven (e.g., 2500 miles). In another example, open-loop air-fuel ratio control may be initiated during the next DFSO event after sensing an air-fuel ratio imbalance during standard engine operating conditions (e.g., all cylinders of an engine are firing). During the open-loop air-fuel ratio control, a selected group of cylinders may be fired and their air-fuel ratio(s) may be detected, as will be discussed with respect to FIG. 6.

Method 500 will be described herein with reference to components and systems depicted in FIGS. 1-3, particularly, regarding engine 10, cylinder banks 30A and 30B, sensor 126, and controller 12. Method 500 may be carried out by the controller according to computer-readable media stored thereon. It should be understood that the method 500 may be applied to other systems of a different configuration without departing from the scope of this disclosure.

Method 500 may begin at 502, and initiate DFSO based on determination of DFSO conditions being met during method 400. Initiating DFSO includes shutting off a fuel supply to all the cylinders of the engine such that combustion may no longer occur (e.g., deactivating the cylinders). At 504, the method 500 determines if an air-fuel ratio imbalance was sensed during nominal engine operation prior to the DFSO, as described above. Additionally or alternatively, the method 500 may also determine if a threshold distance (e.g., 2500 miles) has been traveled by a vehicle since a prior open-loop air-fuel ratio control. If no air-fuel ratio imbalance was detected and/or the threshold distance was not traveled, then the method 500 proceeds to 506. If an air-fuel ratio imbalance was detected, then the method 500 may proceed to 508 to monitor if open-loop air-fuel ratio control is providing expected results.

At 506, method 500 continues operating the engine in DFSO mode until conditions are present where exiting DFSO is desired. In one example, exiting DFSO may be desired when a driver applies the accelerator pedal or when engine speed is reduced to less than a threshold speed. Method 500 exits if conditions are present to exit DFSO mode.

At 508, method 500 monitors conditions for entering open-loop air-fuel. For example, method 500 senses an air-fuel ratio or lambda in the exhaust system (e.g., via monitoring exhaust oxygen concentration) to determine if combusted byproducts have been exhausted from engine cylinders and the engine cylinders are pumping fresh air. After DFSO is initiated, the engine exhaust evolves progressively leaner until the lean air-fuel ratio reaches a saturated value. The saturated value may correspond to an oxygen concentration of fresh air, or it may be slightly richer than a value that corresponds to fresh air since a small amount of hydrocarbons may exit the cylinders even though fuel injection has been cut-off for several engine revolutions. Method 500 monitors the engine exhaust to determine if oxygen content in the exhaust has increased to greater than a threshold value. The conditions may further include identifying if a vehicle is driving at a constant speed. In this way, results measured for each cylinder group may be more consistent than results measured during varying vehicle speed. Method 500 continues to 510 after beginning to monitor the exhaust air-fuel ratio.

At 510, method 500 judges if conditions to enter open-loop air-fuel control have been met. In one example, the select conditions are that the exhaust air-fuel ratio is leaner that a threshold value for a predetermined amount of time (e.g., 1 second). In one example, the threshold value is a value that corresponds to being within a predetermined percentage (e.g., 10%) of a fresh air reading sensed at the oxygen sensor. If the conditions are not met, then the method 500 returns to 508 to continue to monitor if select conditions for entering open-loop air-fuel control have been met. If the conditions for open-loop air-fuel ratio control are met, the method proceeds to 512 to initiate open-loop air-fuel ratio control. The method 500 may then proceed to 602 of method 600. The method for operation of open-loop air-fuel ratio control will be described with respect to FIG. 6.

The methods disclosed herein stand in contrast to those of state-of-the-art air-fuel ratio imbalance monitoring, in which the air-fuel ratio imbalance monitoring relies on the exhaust sensor to accurately measure an air-fuel ratio relative to stoichiometry. The inventors herein have determined that these measurements may be inaccurate due to a geometry of an exhaust passage relative to a location of an exhaust sensor. Additionally or alternatively, this type of air-fuel ratio monitoring may not accurately determine a single cylinder air-fuel ratio while combusting air-fuel mixtures in one or more other cylinders of an engine. The inventors have further determined that during DFSO, an air-fuel ratio imbalance may be detected by firing a cylinder group, comprising at least a cylinder, after a threshold lean air-fuel ratio has been reached. In this way, the method may compare a difference between a lambda of the cylinder group and the threshold lean air-fuel ratio to a difference between an expected lambda of the cylinder group and the threshold lean air-fuel ratio.

Method 500 may be stored in non-transitory memory of controller (e.g., controller 12) to determine if a vehicle may initiate open-loop air-fuel ratio control during DFSO. Upon meeting one or more open-loop air-fuel ratio control conditions, the controller (e.g., the controller in combination with one or more additional hardware devices, such as sensors, valves, etc.) may perform method 600 of FIG. 6.

FIG. 6 illustrates an exemplary method 600 for preforming the open-loop air-fuel ratio control. In one example, open-loop air-fuel ratio control may select a cylinder group in which to reactivate combusting air-fuel mixtures and monitor the air-fuel ratio of the cylinder group during the DFSO. In one example, the cylinder group may be a pair of corresponding cylinders of separate cylinder banks. The cylinders may correspond to one another based on either a firing time or location. As an example, with respect to FIG. 3, cylinders A1 and B1 may comprise a cylinder group. Alternatively, the cylinders may be selected to combust air-fuel mixtures 360 crankshaft degrees apart to provide even firing and smooth torque production. Only a single cylinder may comprise the cylinder group for an in-line engine or for a V-engine, for example.

Method 600 will be described herein with reference to components and systems depicted in FIGS. 1-3, particularly, regarding engine 10, cylinder banks 30A and 30B, sensor 126, and controller 12. Method 600 may be carried out by the controller executing computer-readable media stored thereon. It should be understood that the method 600 may be applied to other systems of a different configuration without departing from the scope of this disclosure.

The approach described herein senses changes in output of the upstream exhaust gas oxygen sensor (UEGO) correlated to combustion events in cylinders that are reactivated during the DFSO event where the engine rotates and a portion of engine cylinders do not combust air-fuel mixtures. The UEGO sensor outputs a signal that is proportionate to oxygen concentration in the exhaust. And, since only one cylinder of a cylinder bank may be combusting air and fuel, the oxygen sensor output may be indicative of cylinder air-fuel imbalance for the cylinder combusting air and fuel. Thus, the present approach may increase a signal to noise ratio for determining cylinder air-fuel imbalance. In one example, the UEGO sensor output voltage (converted to air-fuel ratio or lambda (e.g., air-fuel divided by air-fuel stoichiometric)) is sampled for every cylinder firing during a cylinder group firing after exhaust valves of the cylinder receiving fuel are opened. The sampled oxygen sensor signal is then evaluated to determine a lambda value or air-fuel ratio). The lambda value is expected to correlate to a lambse value (e.g., demanded lambda value).

Method 600 begins at 602 where a cylinder group is selected to later be fired during the open-loop air-fuel ratio control. Selection of the cylinder group may be based on one or more of a firing time and cylinder location, as described above. As one example, with respect to FIG. 3, the cylinders most upstream from an exhaust gas sensor (e.g., sensor 126) may be selected as the cylinder group (e.g., cylinders A1 and B1). Additionally or alternatively, cylinders with corresponding firing times may be selected as the cylinder group (e.g., cylinders A1 and B3). In some examples, the cylinders may combust 360 degrees apart to smooth engine torque production. Consequently, cylinders may be similar in firing time and location. For example, if cylinders A1 and B1 have complementary firing times and are the most upstream cylinders of the exhaust gas sensor. As an example, the cylinder group may comprise at least one cylinder. In some examples, the cylinder group may comprise a plurality of cylinders, further comprising only one cylinder from each cylinder bank. In this way, a number of cylinders in a cylinder group may be equal to a number of cylinder banks, in which each cylinder bank includes only one cylinder combusting air and fuel during an engine cycle (e.g., two revolutions for a four-stroke engine).

After selecting the cylinder group, method 600 proceeds to 603 to determine if conditions for fuel injection to the selected cylinder group are met. Conditions for initiating fuel injection may be determined as described in method 1000 of FIG. 10.

If the fuel injection conditions are not met, then the method 600 may proceed to 604 to continue to monitor fuel injection conditions and determine if fuel injection conditions are met at a later point in time.

If the fuel injection conditions are met, the method 600 may proceed to 605 to combust air and fuel in the selected cylinder group (e.g., firing the cylinder group). Firing the selected cylinder group includes injecting fuel to only the selected cylinder group while maintaining the remaining cylinders as deactivated (e.g., no fuel injected) while the engine continues to rotate. The method 600 may fire the selected group of cylinders one or more times to produce a selected air-fuel perturbation of exhaust air-fuel ratio after combustion products are exhausted after each combustion event in the reactivated cylinder. Fuel is injected into the cylinder before the cylinder fires. For example, if the selected cylinder group comprises cylinders A1 and B1, then both cylinder A1 and cylinder B1 fire. Firing cylinder A1 produces an air-fuel perturbation in exhaust sensed via the oxygen sensor after the combusted mixture in cylinder A1 is expelled to the exhaust system. Firing cylinder B1 produces an air-fuel perturbation in the exhaust sensed via the oxygen sensor after the combusted mixture in cylinder B1 is expelled to the exhaust system. In other words, the combustion gases from cylinders A1 and B1 drive down (e.g., richen) the lean exhaust air-fuel ratios sensed in the respective exhaust passages when all cylinders were deactivated. As mentioned above, a selected cylinder(s) may combust air and fuel over one or more engine cycles while other cylinders remain deactivated and not receiving fuel.

The fuel injection may also include determining an amount of fuel injected, in which the amount of fuel injected may less than a threshold injection. The threshold injection may be based on a drivability, in which injecting an amount of fuel greater than the threshold injection may reduce drivability.

As depicted in FIG. 3, firing the selected cylinder comprising cylinder A1 and cylinder B1 results in exhaust gas from cylinder A1 flowing to sensor 126A and exhaust gas from cylinder B1 flowing to sensor 126B. In this way, each sensor measures only the exhaust gas of an individual cylinder and as a result, sensor blindness may be circumvented.

At 606, the method 600 determines a lambda value each time combustion byproducts are released into the exhaust system from a cylinder combusting air and fuel. The lambda value may be correlated to the amount of fuel injected to the cylinder, and the amount of fuel injected to the cylinder may be based on a fuel pulse width applied to a fuel injector of the cylinder receiving fuel. The fuel pulse width corresponds to an amount of fuel injected to the cylinder. As one example, if both cylinders A1 and B1 are fired 10 times during the cylinder group firing, then 10 separate lambda values may be determined for cylinder A1 and cylinder B1. Method 600 proceeds to 608 after lambda values are determined.

At 608, it is judged whether or not cylinder lambda variation is present. Cylinder to cylinder air-fuel imbalance may result from an air-fuel ratio of one or more cylinders deviating from a desired or expected engine air-fuel ratio.

Cylinder lambda variation may be determined based on comparing one or an average of lambda values against expected lambda values.

In one example, the expected value may be based on a difference between a predetermined maximum lean lambda value (e.g., 2.5λ) when air is being pumped through the engine without injecting fuel) and a predetermined lambda value for the selected cylinder and the amount of fuel injected (e.g., 2.0λ). The difference in this example produces an expected value of 0.5λ. The first of ten lambda values for cylinder A1 is subtracted from the maximum lean lambda value determined at 508 to determine a lambda difference for cylinder A1 for the present DFSO event. The lambda difference for the present DFSO event is then subtracted from the expected lambda value, and if the result is greater than a threshold, it may be determined that cylinder A1 exhibits air-fuel imbalance from other cylinders because its own air-fuel ratio does not match its expected air-fuel ratio. Alternatively, an average of the ten lambda values for cylinder A1 is subtracted from the maximum lean lambda value determined at 508 to determine a lambda difference for cylinder A1 for the present DFSO event. The lambda difference for the present DFSO event is then subtracted from the expected lambda value, and if the result is greater than a threshold, it may be determined that cylinder A1 exhibits imbalance from other cylinders because its own air-fuel ratio does not match its own expected air-fuel ratio. The controller may inject more or less fuel during future cylinder combustions based on a magnitude of difference between the expected lambda value and the lambda value determined based on subtracting the lambda value determined at 606 from the lambda value determined at 508.

In another example, the expected value may be a predetermined single value that the lambda value(s) from cylinder A1 is compared against. For example, if a single expected lambda value is equal to 2.0, but a cylinder combustion lambda is 1.9 from one combustion event determined at 606, then a rich air-fuel ratio cylinder lambda variation may be determined. Alternatively, the single expected lambda value may be compared to the average of the ten lambda values for cylinder A1. The predetermined single expected value may be based on the amount of fuel injected to cylinder A1 for combustion. The controller may inject more or less fuel during future cylinder combustions based on a magnitude of difference between the predetermined single lambda value and the lambda value determined at 606.

In yet another example, the expected value may be a range of lambda (e.g., 2.0λ-1.8λ). One or an average of the ten lambda samples from cylinder A1 may be compared to the expected value range. If the one or average of lambda samples is in the expected range, no imbalance is detected. However, if the one or average of lambda samples is outside of the expected range, it may be determined that there is a cylinder lambda imbalance. Similar analysis with regard to cylinder B1 and other cylinders may be provided. The controller may inject more or less fuel during future cylinder combustions based on a magnitude of difference between the range of lambda and the lambda value determined at 606. For example, if the expected value is a range between 2.0λ and 1.8λ, but the lambda value determined at 606 is 2.1λ, additional fuel may be injected to the cylinder because the lambda value of 2.1 is leaner than expected. The leaner lambda value is compensated by increasing the base amount of fuel injected to the cylinder by a factor based on the lambda error of 0.1.

In still another example, cylinder air-fuel or lambda variation may be determined based on comparing one or an average of air-fuel or lambda values against expected air-fuel or lambda value, where the expected air-fuel or lambda value is a deviation from a maximum lean air-fuel ratio during DFSO. For example, a maximum lean air-fuel ratio during DFSO may be a value of 36:1, and the expected air-fuel value deviation from the maximum lean air-fuel ratio during DFSO is 7. Therefore, if the exhaust air-fuel determined based on combustion in the one cylinder of a cylinder bank firing is 29:1, the measured exhaust air-fuel matches the expected air-fuel ratio deviation and no cylinder air-fuel deviation is determined. However, if the exhaust air-fuel determined based on combustion in the one cylinder of a cylinder bank firing is 22:1, and an air-fuel difference of 7 is determined excessive, it may be determined that there is an air-fuel or lambda deviation that is to be corrected via adjusting fuel injection timing.

The expected air-fuel values may be based on engine speed and load, transmission gear, cylinder position in a cylinder bank, a total amount of fuel supplied to the cylinder receiving the fuel, engine temperature, engine firing order, timing of fueling during the DFSO, and torque transmitted though the transmission. By adjusting the expected air-fuel ratio and the fuel amount injected to produce the expected air-fuel ratio, the signal to noise ratio of cylinder air-fuel ratio may be improved at the UEGO location so that the presence or absence of lambda variation may be more accurately determined.

If the one or average lambda values from cylinder combustion is compared to the expected value and lambda variation is exhibited, the answer is yes and method 600 proceeds to 610. Otherwise, the answer is no and method 600 proceeds to 612.

Figure 8:
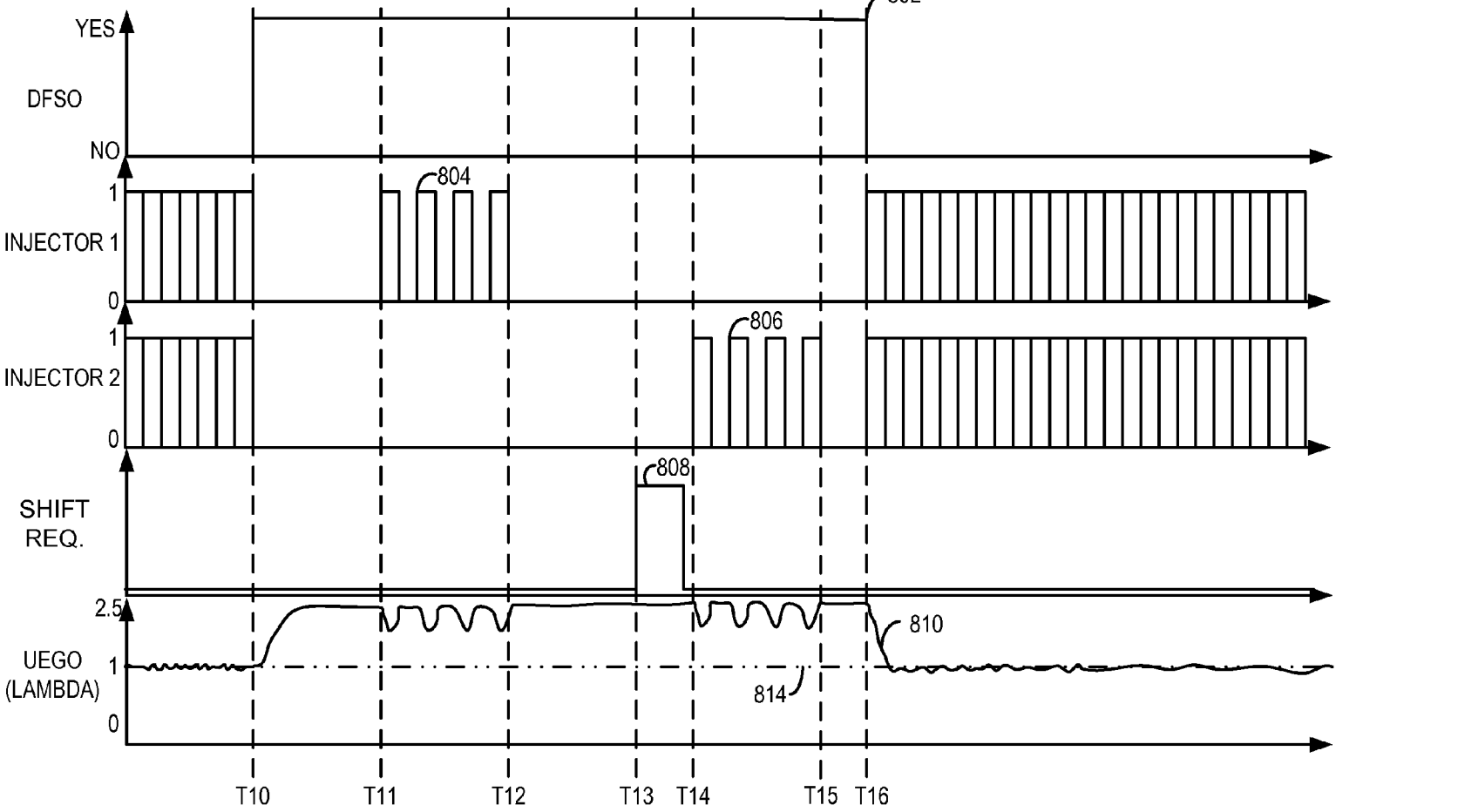
FIG. 8 is a plot of an example DFSO sequence where cylinder lambda variation analysis is delayed in response to a transmission shift request.

It should also be noted that if a transmission shift request is made during the time fuel is injected to the reactivated cylinders, injection of fuel ceases until the shift is complete. If a transmission shift request occurs between injections in different cylinders as is shown in FIG. 8, injection of fuel and lambda variation analysis is delayed until the shift is complete. By not performing lambda analysis and fuel injection during the transmission shift, the possibility of inducing lambda variation may be reduced.

At 610, the method 600 includes learning the injector fueling error. Learning the injector fueling error includes determining if the cylinder air-fuel ratio is leaner (e.g., excess oxygen) or rich (e.g., excess fuel) than expected and storing the learned error for future operation of the cylinder following termination of the DFSO. If the lambda value determined at 606 is less than the threshold range of the expected lambda value (e.g., rich air-fuel ratio), then a controller may learn to inject less fuel during future cylinder combustions based on a magnitude of the imbalance. The magnitude of the lambda error may be equal to a difference between the expected lambda value and the lambda value determined at 608. Learning may include storing a difference between the expected lambda value and the determined lambda value (or the average lambda value) in memory. For example, if a lambda value for a selected cylinder group is 2.1 and the expected lambda value is 2.0, then a lean air-fuel ratio lambda variation may exist with a magnitude of −0.1. The magnitude may be learned and applied to future cylinder combustion subsequent the DFSO such that a fuel injection may compensate the lambda variation of −0.1 (e.g., inject an increased amount of fuel proportional to the magnitude of −0.1) in the cylinder that exhibited the variation. Method 600 proceeds to 612 after leaning cylinder lambda variation for the cylinder in which combustion is activated.

In some examples, additionally or alternatively, cylinder-to-cylinder air/fuel variations may be learned via equation 1 below.

$$AFR_{mean} = \frac{\text{Air flow total}}{\text{sum of fuel delivered to all cylinders}} \quad \text{Equation 1}$$

By calculating the total air/fuel ratio average for all the cylinders, a cylinder group air/fuel ratio average may be compared to the total air/fuel ratio average. If a difference exists between the average for a cylinder group and the total air/fuel ratio average, then a coefficient of inequality may be calculated. The coefficient of inequality may be learned. For example, if the coefficient of inequality is positive, then the air/fuel ratio(s) of the cylinder(s) in the cylinder group may be too high (e.g., amount of air is too high compared to fuel). As a result, adjustments to an engine operation may include injecting more fuel during subsequent engine operation outside of DFSO.

At 612, the method 600 judges if lambda values have been determined for all cylinders. If lambda values of all cylinders have not been assessed and do not have one or more lambda values associated with the cylinders, then the answer is no and method 600 proceed to 613. Otherwise, the answer is yes and method 600 proceeds to 616.

At 613, method 600 judges whether or not DFSO conditions are met or present. A driver may apply an accelerator pedal or engine speed may fall to a speed less than desired so that DFSO conditions are not met. If DFSO conditions are not met, the answer is no and method 600 proceeds to 614. Otherwise, the answer is yes and method 600 proceeds to 615.

At 614, method 600 exits DFSO and returns to closed-loop air-fuel control. Cylinders are reactivated via supplying spark and fuel to the deactivated cylinders. In this way, the open-loop air-fuel ratio control is also disabled despite not having acquired lambda values for all cylinders of the engine. In some examples, if an open-loop air-fuel ratio control is disabled prematurely, then the controller may store any lambda values measured for a selected cylinder group(s) and consequently, select a different cylinder group(s) initially during the next open-loop air-fuel ratio control. Thus, if lambda values are not acquired for a cylinder group during an open-loop air-fuel ratio control, the cylinder group may be the first cylinder group for which lambda values are determined for establishing the presence or absence of imbalance during a subsequent DFSO event. The method 600 proceeds to exit after engine returns to closed-loop air-fuel control.

At 615, method 600 selects a next cylinder group for determining lambda values for establishing the presence or absence of imbalance. Selecting the next cylinder group may include selecting different cylinders other than the cylinders selected in the preceding cylinder group. For example, cylinders A3 and B3 may be selected instead of A1 and B1. Additionally or alternatively, the method 600 may select cylinder groups sequentially along a cylinder bank. For example, cylinders A2 and B3 may comprise a cylinder group after firing cylinders A1 and B1 of a selected cylinder group. Method 600 returns to 603 to reactivate the selected cylinder group, as described above.

At 616, method 600 deactivates open-loop air-fuel ratio control including terminating cylinder activation and selection of cylinder groups. Therefore, method 600 returns to nominal DFSO where all cylinders are deactivated and where cylinder imbalance is not determined. Method 600 proceeds to 618 after the engine renters nominal DFSO.

At 618, method 600 judges whether or not DFSO conditions are met. If the answer is no, method 600 proceeds to 620. Otherwise, the answer is yes and method 600 returns to 618. DFSO conditions may no longer be met if engine speed is reduced to less than a threshold or if the accelerator pedal is applied.

At 620, the method 600 exits DFSO and reactivates all cylinders in closed-loop fuel control. The cylinders may be reactivated according to the firing order of the engine. Method 600 proceeds to 622 after engine cylinders are reactivated.

At 622, method 600 adjusts cylinder operation of any cylinders exhibiting lambda variation as determined at 608. The adjusting may include adjusting amounts of fuel injected to engine cylinders via adjusting fuel injection timing. The fuel injection timing adjustments may be proportional to the difference between the expected lambda value and the determined lambda value as described at 608. For example, if the expected lambda value is 2.0 and the measured lambda value is 1.8, then the error magnitude may be equal to 0.2, indicating a rich air-fuel ratio deviation in the particular cylinder. The adjusting may further include injecting a greater amount of fuel or a lesser amount of fuel based on the type of lambda error. For example, if one cylinder indicates rich lambda variation or error, then the adjustments may include one or more of injecting less fuel and providing more air to the cylinder. The method 600 may exit after applying the adjustments corresponding to the learned lambda errors for each cylinder.

In one example, where the engine is a six cylinder engine having two cylinder banks, the method described in FIGS. 4-6 may determine air-fuel imbalance for cylinders of a bank with cylinders 1-3 based on the following equations:

$$Mf1*k1=\text{mean}(\text{air_charge}/\text{lam_30_cyl1})$$

$$Mf2*k2=\text{mean}(\text{air_charge}/\text{lam_30_cyl2})$$

$$Mf3*k3=\text{mean}(\text{air_charge}/\text{lam_30_cyl3})$$

where Mf1 is mass of fuel injected to cylinder 1 during DFSO, Mf2 is mass of fuel injected to cylinder 2 during DFSO, Mf3 is mass of fuel injected to cylinder 3 during DFSO, mean indicates the mean value of the variables in parenthesis is determined, air_charge is total air flow through the cylinder back having cylinder 1-3 during the time fuel is supplied to cylinders 1-3, lam_30_cyl1 is the average exhaust lambda value when fuel is injected to cylinder 1, lam_30_cyl2 is the average exhaust lambda value when fuel is injected to cylinder 2, and lam_30_cyl3 is the average exhaust lambda value when fuel is injected to cylinder 3. The values of k1-k3 are determined via solving the three equations for the three unknowns. The values of k1-k3 indicate whether or not there is air-fuel imbalance in cylinders 1-3 respectively.

Thus, the method of FIG. 6 provides for a method, comprising: during a deceleration fuel shut-off (DFSO) event, sequentially firing cylinders of a cylinder group, each fueled with a selected fuel pulse width, and indicating an air-fuel ratio variation for each cylinder based on air-fuel deviation from a maximum lean air-fuel ratio during the DFSO. The method further comprises adjusting subsequent engine operation based on the indicated air-fuel ratio variation. The method includes wherein the cylinder group is selected based on one or more of a firing order and a cylinder position within the firing order. The method includes wherein fueling of the cylinder group upon which the indication of air-fuel is based occurs only after the maximum lean air-fuel ratio is measured during the DFSO.

In some examples, the method includes wherein adjusting subsequent engine operation includes adjusting a fuel injector pulse width in response to an expected air-fuel ratio deviation. The method includes wherein an expected air-fuel ratio deviation is based on a selected fuel pulse width. The method includes wherein adjusting subsequent engine operation includes adjusting subsequent fuel injections to a cylinder based on the indicated air-fuel variation following termination of the DFSO. The method includes wherein the cylinder group is fueled and operated to perform a combustion cycle a plurality of times during the DFSO producing a plurality of air-fuel ratio responses that are together used to identify the imbalance.

The method of FIG. 6 also provides for a method, comprising: after disablement all cylinders leading to a common exhaust of an engine: individually fueling one or more of the disabled cylinders to combust a lean air-fuel mixture; and adjusting engine operation in response to a perturbation in exhaust air-fuel ratio from a maximum lean air-fuel ratio. The method includes wherein the perturbation is compared to an expected perturbation. The method includes wherein the expected perturbation is based on engine speed and load. The method includes wherein the expected perturbation is based on an engine temperature. The method includes wherein the expected perturbation is based on cylinder position in a cylinder bank.

Additionally, the method includes wherein the expected perturbation is based on engine firing order. The method includes wherein a total amount of fuel supplied to the one or more disabled cylinders is based on engine speed and load. The method includes wherein a total amount of fuel supplied to the one or more disabled cylinders is based on a transmission gear engaged.

In still another example, the method provides for after disablement all cylinders leading to a common exhaust of an engine: individually fueling one or more of the disabled cylinders to combust a lean air-fuel mixture; and adjusting engine operation in response to an exhaust air-fuel ratio deviation from an expected engine air-fuel ratio, the exhaust air-fuel ratio deviation occurring when all cylinders except a cylinder receiving fuel are deactivated. The method includes wherein the cylinder receiving fuel combusts a plurality of air-fuel mixtures, and where the exhaust air-fuel ratio is based on an average of exhaust air-fuel ratios from the plurality of air-mixtures. The method includes wherein the expected engine air-fuel ratio is based on a speed of a torque converter. The method includes wherein the expected engine air-fuel ratio is based on position of a cylinder in a cylinder bank.

FIG. 7 depicts an operating sequence 700 illustrating example results for an engine cylinder bank comprising three cylinders (e.g., V6 engine with two cylinder banks, each bank comprising three cylinders). Line 702 represents if DFSO is occurring or not, line 704 represents an injector of a first cylinder, line 706 represents an injector of a second cylinder, line 708 represents an injector of a third cylinder, and solid line 710 represents an exhaust gas sensor (UEGO) response in terms of lambda, dotted line 712 represents an expected lambda response, and line 714 represents a stoichiometric lambda value (e.g., 1). Line 712 is a same value as line 710 when only line 710 is visible. For lines 704, 706, and 708, a value of "1" represents a fuel injector injecting fuel (e.g., cylinder firing) and a value of "0" represents no fuel being injected (e.g., cylinder deactivated). The horizontal axes if each plot represent time and time increases from the left side of the figure to the right side of the figure.

Prior to T1, the first, second, and third cylinders are firing under nominal engine operation (e.g., stoichiometric air-fuel ratio), as illustrated by lines 704, 706, and 708 respectively. As a result, the cylinders produce lambda values substantially equal to 1, as indicated by line 710 and line 714. The lambda value may be calculated by a controller (e.g., controller 12) from oxygen concentration in the engine exhaust system as measured by an exhaust gas sensor (e.g., sensor 126). DFSO is disabled, as indicated by line 702.

At T1, DFSO conditions are met and DFSO is initiated, as described above with respect to FIG. 4. As a result, fuel is no longer injected into all the cylinders of the engine (e.g., cylinders are deactivated) and the air-fuel ratio move leaner and increases to a maximum air-fuel ratio, which corresponds to pumping air though engine cylinders without injecting fuel.

After T1 and prior to T2, DFSO continues and the air-fuel ratio continues to increase to the maximum lean air-fuel ratio. The injectors may not begin injecting fuel until a threshold time (e.g., 5 seconds) has passed subsequent to initiating the DFSO. Additionally or alternatively, the injectors may begin injecting fuel in response to the maximum air-fuel ratio being detected by the UEGO sensor. Conditions for firing a selected cylinder group are monitored.

At T2, the first cylinder is activated due to conditions for firing the selected cylinder group being met (e.g., no zero point torque, vehicle speed is less than a threshold vehicle speed, and no downshift) and therefore, injector 1 injects fuel into the first cylinder. As described above, a selected cylinder group may comprise at least one cylinder from each cylinder bank. That is to say, the number of cylinder banks may be equal to the number of cylinders in the cylinder group, in which each cylinder bank provides one cylinder to the cylinder group. Additionally or alternatively, a selected cylinder group for an in-line engine may comprise at least one cylinder of the engine.

After T2 and prior to T3, the first cylinder is combusting. As shown, the first cylinder combusts four times and produces four separate fuel pulse widths, each fuel pulse width corresponding to a single combustion event. The exhaust oxygen concentration is measured by the UEGO sensor (e.g., exhaust gas sensor) and the controller produces a lambda value corresponding to each combustion event based on UEGO output. As will be appreciated by one skilled in the art, other suitable numbers of firings may be performed. As depicted, the fuel injections to the first cylinder produce similar lambda values upon combustion. However, in some examples, the open-loop air-fuel ratio control may determine to inject various amounts of fuel such that each injection provides a substantially different amount of fuel injected and different lambda values.

The first cylinder measured lambda values are compared to an expected lambda value, line 712. If the measured lambda values are not equal to the expected lambda value, then an air-fuel ratio variation or lambda value that may cause cylinder to cylinder air-fuel imbalance may be indicated and learned, as described above with respect to FIG. 6. However, as depicted, the first cylinder lambda values are equal to the expected lambda values, thus no air-fuel ratio variation or error value is learned.

In some examples, a fired cylinder may produce a lambda difference, in which the lambda difference is defined as a difference between the maximum lean air-fuel ratio and a measured lambda (e.g., 2.5−2.0=0.5). The lambda difference may be compared to an expected lambda difference. If the lambda difference is not substantially equal to the expected difference then an air-fuel ratio imbalance may be indicated and learned. The learned imbalance may be based on an error magnitude. For example, if a measured lambda difference is 0.5, but an expected lambda difference is 0.4, then an error magnitude of 0.1 exists. In this way, the learned fueling error may be the basis for adjusting fueling operations for fuel injection subsequent the DFSO. For example, the base fuel amount to achieve a desired lambda value in a cylinder may be adjusted proportional to the error magnitude of 0.1 to correct the cylinder lambda variation.

In some examples, additionally or alternatively, the measured lambda value may be compared to a threshold range, as described above. If the measured lambda value is not within the threshold range, then an imbalance may be indicated and learned. Additionally or alternatively, in some examples, the open-loop air-fuel ratio control may operate for a given number of time and the results may be averaged to indicate an air-fuel ratio imbalance, if any.

At T3, the first cylinder is deactivated and DFSO continues. The air-fuel ratio returns to the maximum lean air-fuel ratio. After T3 and prior to T4, the DFSO continues without firing a selected cylinder group. As a result, the air-fuel ratio remains at the maximum lean air-fuel ratio. The open-loop air-fuel ratio control may select a next cylinder group to fire. The open-loop air-fuel ratio control may allow the air-fuel ratio to return to the maximum lean air-fuel ratio prior to firing the next cylinder group in order maintain a consistent background (e.g., the maximum lean air-fuel ratio) for each cylinder group. Conditions for firing the next cylinder group are monitored.

In some examples, additionally or alternatively, firing the next cylinder group may occur directly after firing a first cylinder group. In this way, the open-loop air-fuel ratio control may select the next cylinder group at T3 and not allow the lambda to return to the maximum lean air-fuel ratio, for example.

At T4, the second cylinder is activated and injector 2 injects fuel into the second cylinder due to cylinder firing conditions being met. The DFSO continues and the first and third cylinders remain deactivated. After T4 and prior to T5, the second cylinder is fired four times and four fuel pulse widths are produced, each fuel pulse width corresponding to a single combustion event in the second cylinder. The exhaust oxygen concentration is converted into a measured lambda value corresponding to a lambda value for the second cylinder. The measured lambda values of the second cylinder are substantially equal to the expected lambda values. Therefore, no air-fuel ratio imbalance is learned.

At T5, the second cylinder is deactivated and as a result, the lambda value increases towards the maximum lean air-fuel ratio lambda value. DFSO continues. After T5 and prior to T6, the open-loop air-fuel ratio control selects a next cylinder group and allows the lambda to return to the maximum lean air-fuel ratio prior to firing the next cylinder group. DFSO continues with all the cylinders remaining deactivated. Conditions for firing the next cylinder group are monitored.

At T6, the third cylinder is activated and injector 3 injects fuel into the third cylinder due to cylinder firing conditions being met. The DFSO continues and the first and second cylinders remains deactivated. After T6 and prior to T7, the third cylinder is fired four times and four fuel pulse widths are produced, each fuel pulse width corresponding to a single combustion event within the third cylinder. The exhaust gas oxygen concentration is converted into a measured lambda values corresponding to combustion events in the third cylinder. The measured lambda values of the third cylinder are less than the expected lambda value line 712. Therefore, the third cylinder has an air-fuel ratio imbalance, more specifically, a lean air-fuel ratio error or variance. The air-fuel error or lambda error for the third cylinder is learned and may be applied to future third cylinder operations during engine operations subsequent the DFSO.

At T7, the third cylinder is deactivated and thus all the cylinder are deactivated. The open-loop air-fuel ratio control is deactivated and DFSO may continue until DFSO conditions are no longer met. After T7 and prior to T8, DFSO continues and all cylinders remain deactivated. The lambda measured by the UEGO sensor is equal to the maximum lean air-fuel ratio.

At T8, the DFSO conditions are no longer met (e.g., tip-in occurs) and the DFSO is deactivated. Deactivating the DFSO includes injecting fuel into all the cylinders of the engine. Therefore, the first cylinder receives fuel from the injector 1 and the second cylinder receives fuel from the injector 2 without any adjustments learned during the open-loop air-fuel ratio control. The fuel injector of the third cylinder may receive fuel injection timing adjustments based on the learned air-fuel ratio variation to increase or decrease fuel supplied to the third cylinder. The adjustment(s) may include injecting an increased amount of fuel compared to fuel injections during similar conditions prior to the DFSO because the learned air-fuel ratio variation is based on a lean air-fuel ratio variation. By injecting an increased amount of fuel, the third cylinder air-fuel ratio may be substantially equal to a stoichiometric air-fuel ratio (e.g., lambda equal to 1). After T8, nominal engine operation continues. DFSO remains deactivated. The first, second, and third cylinders are fired and the UEGO sensor measures a lambda value substantially equal to stoichiometric.

Referring now to FIG. 8, a vehicle DFSO sequence where lambda variation analysis is delayed to reduce the possibility of lambda error is shown. Sequence 800 shows fuel injection for a second cylinder being delayed in response to a transmission shift request. Example results for an engine cylinder bank comprising three cylinders (e.g., V6 engine with two cylinder banks, each bank comprising three cylinders) are shown. Line 802 represents if DFSO is occurring or not, line 804 represents an injector of a first cylinder, line 806 represents an injector of a second cylinder, line 808 represents whether or not a transmission shift request is present, and solid line 810 represents an exhaust gas sensor (UEGO) response in terms of lambda, dotted line 812 represents an expected lambda response, and line 814 represents a stoichiometric lambda value (e.g., 1). Line 812 is a same value as line 810 when only line 810 is visible. For lines 804 and 806, a value of "1" represents a fuel injector injecting fuel (e.g., cylinder firing) and a value of "0" represents no fuel being injected (e.g., cylinder deactivated). A transmission shift request is present when line 808 is at a higher level. A transmission shift request is not present when line 808 is at a lower level. The horizontal axes if each line represent time and time increases from the left side of the figure to the right side of the figure.

Prior to T10, the first and second cylinders are firing under nominal engine operation (e.g., stoichiometric air-fuel ratio), as illustrated by lines 804 and 806. A transmission shift is not requested. The cylinders produce exhaust lambda values substantially equal to 1, as indicated by line 810 and line 814. The lambda value may be calculated by a controller (e.g., controller 12) from oxygen concentration in the engine exhaust system as measured by an exhaust gas sensor (e.g., sensor 126). DFSO is disabled, as indicated by line 802.

At T10, DFSO conditions are met and DFSO is initiated, as described above with respect to FIG. 4. As a result, fuel is no longer injected into all the cylinders of the engine (e.g., cylinders are deactivated) and the air-fuel ratio move leaner and increases to a maximum air-fuel ratio, which corresponds to pumping air though engine cylinders without injecting fuel.

After T10 and prior to T11, DFSO continues and the air-fuel ratio continues to increase to the maximum lean air-fuel ratio. The injectors may not begin injecting fuel until a threshold time (e.g., 5 seconds) has passed subsequent to initiating the DFSO. Additionally or alternatively, the injectors may not begin injecting fuel until the maximum air-fuel ratio is detected by the UEGO sensor. Conditions for firing a selected cylinder group are monitored.

At T11, the first cylinder is activated due to conditions for firing the selected cylinder group being met (e.g., no zero point torque, vehicle speed is less than a threshold vehicle speed, and no downshift) and therefore, injector 1 injects fuel into the first cylinder. As described above, a selected cylinder group may comprise at least one cylinder from each cylinder bank. That is to say, the number of cylinder banks may be equal to the number of cylinders in the cylinder group, in which each cylinder bank provides one cylinder to the cylinder group. Additionally or alternatively, a selected cylinder group for an in-line engine may comprise at least one cylinder of the engine. Furthermore, the selected cylinder group may be selected based on one or more of a firing order and location, in which the cylinders are sequentially selected to comprise a selected cylinder group to be fired. For example, with respect to FIG. 3, cylinders A1 and B1 may comprise a first selected cylinder group. After testing the first selected cylinder group, a second selected cylinder group may comprise cylinders A2 and B2 to be fired. In this way, the cylinders may be selected sequentially for future select cylinder groups.

After T11 and prior to T12, the first cylinder is combusting. As shown, the first cylinder combusts four times and produces four separate fuel pulse widths, each fuel pulse width corresponding to a single combustion event. The exhaust oxygen concentration is measured by the UEGO sensor (e.g., exhaust gas sensor) and the controller produces a lambda value corresponding to each combustion event based on UEGO output. As will be appreciated by one skilled in the art, other suitable numbers of firings may be performed. As depicted, the fuel injections to the first cylinder produce similar lambda values upon combustion. However, in some examples, the open-loop air-fuel ratio control may determine to inject various amounts of fuel such that each injection provides a substantially different amount of fuel injected and different lambda values.

The first cylinder measured lambda values are compared to an expected lambda value, line 812. If the measured lambda values are not equal to the expected lambda value, then an air-fuel ratio variation or lambda value that may cause cylinder to cylinder air-fuel imbalance may be indicated and learned, as described above with respect to FIG. 6. However, as depicted, the first cylinder lambda values are equal to the expected lambda values, thus no air-fuel ratio variation or error value is learned.

At T12, the first cylinder is deactivated and DFSO continues. The air-fuel ratio returns to the maximum lean air-fuel ratio. After T12 and prior to T13, the DFSO continues without firing a selected cylinder group. As a result, the air-fuel ratio remains at the maximum lean air-fuel ratio. The open-loop air-fuel ratio control may select a next cylinder group to fire. The open-loop air-fuel ratio control may allow the air-fuel ratio to return to the maximum lean air-fuel ratio prior to firing the next cylinder group in order maintain a consistent background (e.g., the maximum lean air-fuel ratio) for each cylinder group. Conditions for firing the next cylinder group are monitored.

At T13, the second cylinder is prepared for activation, but a request for a transmission shift is made as indicated by line 808 transitioning to a higher level. The second cylinder activation is delayed in response to the transmission shift request to reduce the possibility of inducing lambda errors in the output of the second cylinder. The engine stays in DFSO and the shift commences. Activation of the second cylinder is delayed until the shift is complete. The shift (e.g., a downshift) is complete shortly before time T14.

At T14, the second cylinder is activated and injector 2 injects fuel into the second cylinder due to cylinder firing conditions being met. The DFSO continues and the first cylinder remains deactivated. After T14 and prior to T15, the second cylinder is fired four times and four fuel pulse widths are produced, each fuel pulse width corresponding to a single combustion event in the second cylinder. The exhaust oxygen concentration is converted into a measured lambda value corresponding to a lambda value for the second cylinder. The measured lambda values of the second cylinder are substantially equal to the expected lambda values. Therefore, no air-fuel ratio imbalance is learned.

At T15, the second cylinder is deactivated and as a result, the lambda value increases towards the maximum lean air-fuel ratio lambda value. DFSO continues. After T15 and prior to T16, the open-loop air-fuel ratio control allows the lambda to return to the maximum lean air-fuel ratio. DFSO continues with all the cylinders remaining deactivated.

At T16, DFSO conditions are no longer present so the first and second cylinders are reactivated. The engine air-fuel ratio resumes stoichiometric and the engine begins to produce positive torque.

Thus, analysis of lambda variation and firing of cylinders while the engine's remaining cylinders remain deactivated may be delayed in response to a transmission request. Further, if a transmission request occurs when a cylinder is active while other cylinders are deactivated, lambda variation analysis including firing the one active cylinder may be delayed until the shift is complete. In this way, the possibility of lambda errors due to transmission gear shifting may be reduced.

Figure 9:
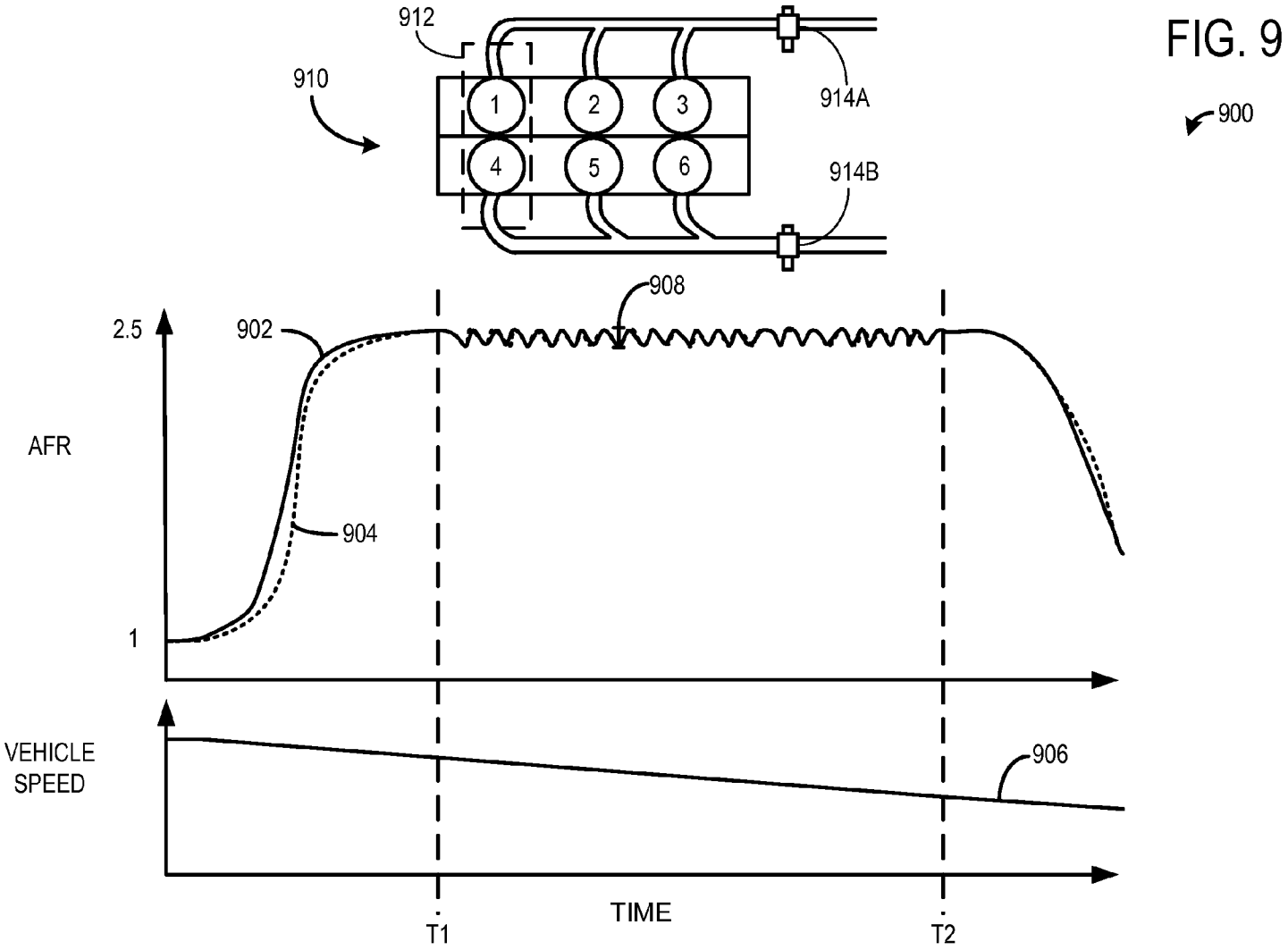
FIG. 9 is plot of an example DFSO sequence where lambda variation analysis is performed for two cylinder groups at a same time.

Turning now to FIG. 9, an example engine configuration 910 and DFSO sequence 900 are shown. Sequence 900 depicts output of UEGO sensors when an engine is in DFSO and fuel is open-loop air-fuel ratio controlled in two different cylinder banks Graph 902 represents an air-fuel ratio for exhaust in the exhaust system downstream of cylinder 1 of a cylinder group 912. Graph 904 represents an air-fuel ratio for exhaust in the exhaust system downstream of cylinder 4 of the cylinder group 912. Graph 906 represents a vehicle speed. Air-fuel ratio amplitude 908 represents an air-fuel ratio deviation between an air fuel ratio responsive to a commanded fuel pulse and a baseline air-fuel ratio (e.g., a maximum lean air-fuel ratio where no fuel pulse is output).

Engine 910 represents a V6 engine divided into two banks comprised of three cylinders. Dashed box 912 represents a first cylinder group, and sensors 914A and 914B represent UEGO sensors capable of measuring or inferring air/fuel ratios in the respective cylinder banks. Graph 904 is equal to graph 902 when only graph 902 is visible.

Prior to T1, a vehicle speed is relatively constant as shown by graph 906 and then it begins to decrease as the vehicle decelerates. The vehicle may decelerate in response to a reduction in driver demand torque. As a result, DFSO conditions are met and the vehicle begins to deactivate all the cylinders of the engine 910. Consequently, the air-fuel ratio in the exhaust system begins to increase to a maximum lean air-fuel ratio (e.g., 2.5A), as indicated by graphs 902 and 904 respectively.

At T1, the air-fuel ratio in each exhaust system reaches the maximum lean air-fuel ratio. Consequently, a controller of the engine 910 initiates open-loop air-fuel ratio control for determining cylinder air-fuel ratio imbalance, as described above with respect to FIG. 5. Cylinder 1 and 4 are selected as part of a cylinder group, as seen by dashed box 912. In this way, only cylinders 1 and 4 may receive discontinuous pulses of fuel while the remaining cylinders only receive air. By doing this, cylinders 1 and 4 may have their air-fuel ratios accurately monitored without influence or disturbances from the other cylinders. As described above, it may be difficult distinguish air-fuel ratios of different cylinders of a cylinder bank via a single UEGO sensor due to exhaust mixing in the exhaust system.

After T1 and prior to T2, the open-loop air-fuel ratio control begins to inject enough fuel into cylinders 1 and 4 of the cylinder group 912 such that the UEGO sensors may measure the exhaust without creating a torque disturbance (e.g., change in vehicle speed due to a torque change). In this way, a driver may not feel the effects of firing a select group of cylinders during the open-loop air-fuel ratio. Cylinders 1 and 4 are fired a plurality of times and an amplitude 908 of each combustion is measured and compared to a threshold value. As described above, the threshold value may be a total air-fuel ratio average for all the cylinders of the engine. If there is a difference between the amplitude and the total air-fuel ratio average then an imbalance for a cylinder may exist. For example, if sensor 914A measures a lambda value equal to 2.3λ for cylinder 1 while a total air-fuel ratio average is 2.2λ, then a controller may learn a 0.1λ difference and inject more fuel to cylinder 1 during engine operation following termination of the open-loop air-fuel ratio control and the DFSO. By adjusting cylinder fueling this way, cylinder-to-cylinder variation may be mitigated. Additionally, by measuring the air-fuel ratio during DFSO, the sensor may detect a magnitude of an imbalance (e.g., lean or rich) and appropriately control an amount of fuel injected during nominal engine operation.

At T2, the vehicle exits DFSO in response to operating conditions such as vehicle speed being less than a threshold speed. As a result, open-loop air-fuel ratio control is disabled despite not analyzing air-fuel imbalance for all the cylinders of the engine 910. A subsequent DFSO event may include open-loop air-fuel ratio beginning by selecting a cylinder group different than cylinder group 912 for open-loop air-fuel ratio control. It may be preferred to conduct the open-loop air-fuel ratio control at similar vehicle conditions, such as a same vehicle speed and road grade because results measured for different select cylinder groups may be more consistent for similar conditions. For example, the total air/fuel ratio average may change as the vehicle speed changes creating different amplitude measurements and ultimately resulting in undesirable learned adjustments. All cylinders of the engine are re-activated upon disabling DFSO.

After T2, the vehicle speed continues to decrease and the air-fuel ratio in the exhaust downstream of cylinders 1 and 4 begin to decrease to stoichiometric air-fuel ratios. DFSO and open-loop air-fuel ratio control remain disabled.

In this way, during a DFSO, an air-fuel ratio may be detected independent of a stoichiometric air-fuel ratio being measured. By doing this, the air-fuel ratio may be detected more accurately. Sensor blindness due to geometry of an exhaust manifold may no longer be a concern due to a sensor measuring an air-fuel ratio of only a single cylinder. In this way, an exhaust gas of one cylinder may not disrupt a measurement of an exhaust gas of another sensor.

The technical effect of measuring an air-fuel ratio of a cylinder group during a DFSO is to more accurately attribute a measured air-fuel ratio to a specific cylinder. By measuring only a single cylinder of an engine bank, a measured lambda value can be attributed to the single cylinder. In this way, an air-fuel balance may be learned and applied to the cylinder in question with greater confidence.

A method, comprising during a deceleration fuel shut-off (DFSO) event, sequentially firing cylinders of a cylinder group, each fueled with a selected fuel pulse width, and indicating an air-fuel ratio variation for each cylinder based on air-fuel deviation from a maximum lean air-fuel ratio during the DFSO. Further comprising adjusting subsequent engine operation based on the indicated air-fuel ratio variation. The cylinder group is selected based on one or more of a firing order and a cylinder position within the firing order. The method, additionally or alternatively, further includes fueling of the cylinder group upon which the indication of air-fuel is based occurs only after the maximum lean air-fuel ratio is measured during the DFSO. An expected air-fuel ratio deviation is based on a selected fuel pulse width. The adjusting subsequent engine operation includes adjusting subsequent fuel injections to a cylinder based on the indicated air-fuel variation following termination of the DFSO. The cylinder group is fueled and operated to perform a combustion cycle a plurality of times during the DFSO producing a plurality of air-fuel ratio responses that are together used to identify the imbalance.

A second method, comprising after disabling all cylinders leading to a common exhaust of an engine: individually fueling one or more of the disabled cylinders to combust a lean air-fuel mixture; and adjusting engine operation in response to a perturbation in exhaust air-fuel ratio from a maximum lean air-fuel ratio. The perturbation is compared to an expected perturbation. The expected perturbation is based on engine speed and load. The expected perturbation, additionally or alternatively, is further based on one or more of a cylinder position in a cylinder bank and an engine firing order. A total amount of fuel supplied to the one or more disabled cylinders is based on engine speed and load. The total amount of fuel supplied to the one or more disabled cylinders is based on a transmission gear engaged.

A third method of an engine, comprising after disabling all cylinders leading to a common exhaust of an engine: individually fueling one or more of the disabled cylinders to combust a lean air-fuel mixture; and adjusting engine operation in response to an exhaust air-fuel ratio deviation from an expected engine air-fuel ratio, the exhaust air-fuel ratio deviation occurring when all cylinders except a cylinder receiving fuel are deactivated. The cylinder receiving fuel combusts a plurality of air-fuel mixtures, and where the exhaust air-fuel ratio is based on an average of exhaust air-fuel ratios from the plurality of air-mixtures. The expected engine air-fuel ratio is based on a speed of a torque converter. The expected engine air-fuel ratio is based on position of a cylinder in a cylinder bank.

Figure 10:
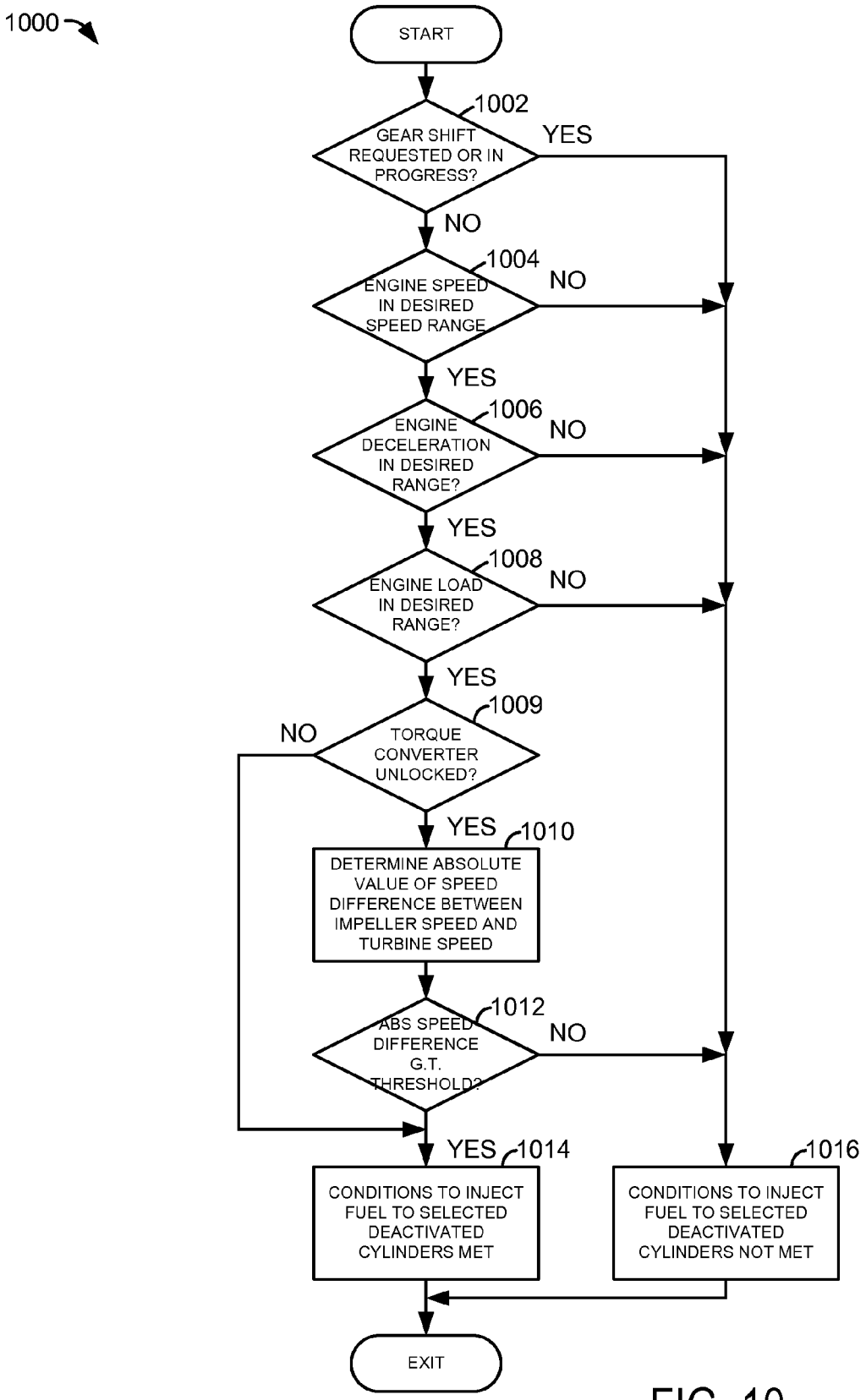
FIG. 10 is a flowchart of a method for determining if fuel injection is to be activated in selected cylinders to determine cylinder air-fuel ratio imbalance.

Referring now to FIG. 10, a method for judging whether or not to supply fuel to reactivate deactivated cylinders for the purpose of determining cylinder imbalance is shown. The method of FIG. 10 may be applied in conjunction with the method if FIGS. 4-6 to provide the sequences shown in FIGS. 7-9. Alternatively, the method of FIG. 10 may be the basis for when samples of exhaust gases may be included for determining cylinder air-fuel imbalance.

At 1002, method 1000 judges whether or not a request to shift transmission gears is present or if a transmission gear shift is in progress. In one example, method 1000 may determine a shift is requested or in progress based on a value of a variable in memory. The variable may change state based on vehicle speed and driver demand torque. If method 1000 judges that a transmission gear shift is requested or in progress, the answer is yes and method 1000 proceeds to 1016. Otherwise, the answer is no and method 1000 proceeds to 1004. By not injecting fuel to deactivated cylinders during transmission gear shifts, air-fuel ratio variation may be reduced to improve the air-fuel signal to noise ratio.

At 1004, method 1000 judges whether or not a request engine speed is within a desired speed range (e.g., 1000-3500 RPM). In one example, method 1000 may determine engine speed from an engine position or speed sensor. If method 1000 judges that the engine speed is within a desired range, the answer is yes and method 1000 proceeds to 1006. Otherwise, the answer is no and method 1000 proceeds to 1016. By not injecting fuel to deactivated cylinders when engine speed is out of range, air-fuel ratio variation may be reduced to improve the air-fuel signal to noise ratio.

At 1006, method 1000 judges whether or not a request engine deceleration is within a desired range (e.g., less than 300 RPM/sec.). In one example, method 1000 may determine engine deceleration from the engine position or speed sensor. If method 1000 judges that the engine deceleration is within a desired range, the answer is yes and method 1000 proceeds to 1008. Otherwise, the answer is no and method 1000 proceeds to 1016. By not injecting fuel to deactivated cylinders when engine deceleration rate is out of range, air-fuel ratio variation may be reduced to improve the air-fuel signal to noise ratio.

At 1008, method 1000 judges whether or not engine load is within a desired range (e.g., between 0.1 and 0.6). In one example, method 1000 may determine engine load from an intake manifold pressure sensor or a mass air flow sensor. If method 1000 judges that the engine load is within a desired range, the answer is yes and method 1000 proceeds to 1009. Otherwise, the answer is no and method 1000 proceeds to 1016. By not injecting fuel to deactivated cylinders when engine load is out of range, air-fuel ratio variation may be reduced to improve the air-fuel signal to noise ratio.

At 1009, method 1000 judges whether or not the torque converter clutch is open and the torque converter is unlocked. If the torque converter is unlocked, the torque converter turbine and impeller may rotate at different speeds. The torque converter impeller and turbine speeds may be indicative of whether or not the driveline is passing through or being at a zero torque point. However, if the torque converter clutch is locked, the indication of the zero torque point may be less clear. The torque converter clutch state may be sensed or a bit in memory may indicate whether or not the torque converter clutch is open. If the torque converter clutch is unlocked, the answer is yes and method 1000 proceeds to 1010. Otherwise, the answer is no and method 1000 proceeds to 1014. Thus, in some examples, the torque converter clutch may be commanded open to unlock the torque converter when the determination of cylinder air-fuel ratio imbalance is desired.

At 1010, method 1000 determines an absolute value of a difference between torque converter impeller speed and torque converter turbine speed. The speed difference may be indicative of the engine transitioning through a zero torque point where engine torque is equivalent to driveline torque. During vehicle deceleration, engine torque may be reduced and vehicle inertia may transfer a negative torque from vehicle wheels into the vehicle driveline. Consequently, a space between vehicle gears referred to gear lash may increase to where the gears briefly fail to positively engage, and then the gears engage on an opposite side of the gears. The condition where there is a gap between gear teeth (e.g., gear teeth are not positively engaged) is the zero torque point. The increase in gear lash and subsequent reengagement of gear teeth may cause driveline torque disturbances which may induce cylinder air amount changes that may result in air-fuel ratio variation. Therefore, it may be desirable to not inject fuel to select cylinders at the zero torque point during DFSO to reduce the possibility of skewing air-fuel ratio imbalance determination. Torque converter impeller speed being within a threshold speed of torque converter turbine speed (e.g., within ±25 RPM) may be indicative of being at or passing through the zero torque point where space between gears increases or lash develops. Therefore, fuel injection may be ceased until the driveline transitions through the zero torque point to avoid the possibility of inducing air-fuel ratio imbalance determination errors. Alternatively, fuel injection may not be started until after the driveline passes through the zero torque point and gear teeth reengage during DFSO. Method 1000 proceeds to 1012 after the absolute value of the difference in turbine speed and impeller speed is determined.

At 1012, method 1000 judges if the absolute value of the difference in torque converter impeller speed and torque converter turbine speed is greater than a threshold (e.g., 50 RPM). If so, the answer is yes and method 1000 proceeds to 1014. Otherwise, the answer is no and method 1000 proceeds to 1016.

At 1014, method 1000 indicates that conditions for activating fuel injection to selected engine cylinders during DFSO to determine cylinder air-fuel imbalance are met. Consequently, one or more deactivated engine cylinders may be reactivated by injecting fuel into the select cylinders and combusting the fuel. Method 1000 indicates to the method of FIGS. 4-6 that conditions for injecting fuel to select deactivated cylinders during DFSO are present and exits.

Alternatively at 1014, method 1000 indicates that conditions for applying or using exhaust air-fuel or lambda samples to determine cylinder air-fuel imbalance are met. Therefore, exhaust samples may be included to determine an average exhaust lambda or air-fuel value for cylinders reactivated during DFSO.

At 1016, method 1000 indicates that conditions for activating fuel injection to selected engine cylinders during DFSO to determine cylinder air-fuel imbalance are not met. Consequently, one or more deactivated engine cylinders continue to be deactivated until conditions for injecting fuel to deactivated cylinders are present. Additionally, it should be noted that fueling of one or more cylinders may be stopped and then restarted in response to conditions for injecting fuel changing from being present to not being present then later being present. In some examples, analysis for cylinder imbalance starts over for cylinders receiving fuel so that the cylinder's air-fuel ratio is not averaged based on air-fuel ratio before and after conditions where fuel is not injected. Method 1000 indicates to the method of FIGS. 4-6 that conditions for injecting fuel to select deactivated cylinders during DFSO are not present and exits.

Alternatively at 1016, method 1000 indicates that conditions for applying or using exhaust air-fuel or lambda samples to determine cylinder air-fuel imbalance are not met. Therefore, exhaust samples may not be included to determine an average exhaust lambda or air-fuel value for cylinders reactivated during DFSO.

In this way, the open-loop air-fuel ratio control may be more consistent (e.g., replicated) from a first selected cylinder group to a second selected cylinder group. It will be appreciated by one skilled in the art that other suitable conditions and combinations thereof may be applied to begin fuel injection to cylinders deactivated during the DFSO event. For example, fuel injection may begin a predetermined amount of time after an exhaust air-fuel ratio is leaner than a threshold air-fuel ratio.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example examples described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific examples are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

during a deceleration fuel shut-off (DFSO) event, sequentially firing cylinders of a cylinder group, each fueled with a selected fuel pulse width, and indicating an air-fuel ratio variation for each cylinder based on air-fuel deviation from a maximum lean, saturated, air-fuel ratio corresponding to an oxygen concentration of fresh air, compared with an expected air-fuel ratio deviation from the maximum lean air-fuel ratio during the DFSO.

2. The method of claim 1, further comprising adjusting subsequent engine operation based on the indicated air-fuel ratio variation.

3. The method of claim 2, wherein the cylinder group is selected based on one or more of a firing order and a cylinder position within the firing order.

4. The method of claim 2, wherein fueling of the cylinder group upon which the indication of air-fuel ratio variation is based occurs only after the maximum lean air-fuel ratio is measured during the DFSO.

5. The method of claim 2, wherein adjusting subsequent engine operation includes adjusting a fuel injector pulse width in response to the expected air-fuel ratio deviation.

6. The method of claim 5, wherein the expected air-fuel ratio deviation is based on a selected fuel pulse width.

7. The method of claim 2, wherein adjusting subsequent engine operation includes adjusting subsequent fuel injections to a cylinder based on the indicated air-fuel ratio variation following termination of the DFSO.

8. The method of claim 1, wherein the cylinder group is fueled and operated to perform a combustion cycle a plurality of times during the DFSO producing a plurality of air-fuel ratio responses that are together used to identify an imbalance.

9. A method, comprising:

after disabling all cylinders leading to a common exhaust of an engine, individually fueling one or more of the disabled cylinders to combust a lean air-fuel mixture; and adjusting engine operation in response to a comparison of a perturbation in exhaust air-fuel ratio from a maximum lean air-fuel ratio to an expected air-fuel ratio deviation from the maximum lean air-fuel ratio, the maximum lean air-fuel ratio being a saturated air-fuel ratio corresponding to an oxygen concentration of fresh air.

10. The method of claim 9, wherein the perturbation is compared to an expected perturbation.

11. The method of claim 10, wherein the expected perturbation is based on engine speed and load.

12. The method of claim 10, wherein the expected perturbation is based on an engine temperature.

13. The method of claim 10, wherein the expected perturbation is based on cylinder position in a cylinder bank.

14. The method of claim 10, wherein the expected perturbation is based on engine firing order.

15. The method of claim 10, wherein a total amount of fuel supplied to the one or more disabled cylinders is based on engine speed and load.

16. The method of claim 10, wherein a total amount of fuel supplied to the one or more disabled cylinders is based on a transmission gear engaged.

17. A method, comprising:

after disabling all cylinders leading to a common exhaust of an engine, individually fueling one or more of the disabled cylinders to combust a lean air-fuel mixture; and adjusting engine operation in response to a comparison of an exhaust air-fuel ratio deviation from a maximum lean air fuel ratio to an expected air-fuel ratio deviation from the maximum lean air-fuel ratio, the maximum lean air-fuel ratio being a saturated air-fuel ratio corresponding to an oxygen concentration of fresh air, the exhaust air-fuel ratio deviation occurring when all cylinders except a cylinder receiving fuel are deactivated.

18. The method of claim 17, wherein the cylinder receiving fuel combusts a plurality of air-fuel mixtures, and where the exhaust air-fuel ratio deviation is based on an average of exhaust air-fuel ratios from the plurality of air-fuel mixtures.

19. The method of claim 17, wherein the maximum lean air-fuel ratio is based on a speed of a torque converter.

20. The method of claim 17, wherein the maximum lean air-fuel ratio is based on a position of a cylinder in a cylinder bank.

* * * * *